US008228283B2

(12) United States Patent
Kitayama et al.

(10) Patent No.: US 8,228,283 B2
(45) Date of Patent: Jul. 24, 2012

(54) LIQUID CRYSTAL PANEL DRIVING APPARATUS, LIQUID CRYSTAL DISPLAY APPARATUS, METHOD FOR DRIVING LIQUID CRYSTAL DISPLAY APPARATUS, DRIVE CONDITION SETTING PROGRAM, AND TELEVISION RECEIVER

(75) Inventors: Masae Kitayama, Osaka (JP); Fumikazu Shimoshikiryoh, Osaka (JP); Kentaro Irie, Osaka (JP); Toshihide Tsubata, Osaka (JP); Naoshi Yamada, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 251 days.

(21) Appl. No.: 12/451,982

(22) PCT Filed: Apr. 9, 2008

(86) PCT No.: PCT/JP2008/057038

§ 371 (c)(1),
(2), (4) Date: Dec. 10, 2009

(87) PCT Pub. No.: WO2008/152857

PCT Pub. Date: Dec. 18, 2008

(65) Prior Publication Data

US 2010/0123832 A1 May 20, 2010

(30) Foreign Application Priority Data

Jun. 12, 2007 (JP) ..... 2007-155651

(51) Int. Cl.
*G09G 3/36* (2006.01)

(52) U.S. Cl. ..... 345/100; 345/204

(58) Field of Classification Search ..... 345/87–104, 345/204, 690, 208–211
See application file for complete search history.

(56) References Cited

U.S. PATENT DOCUMENTS 4,345,249 A 8/1982 Togashi
6,661,488 B1 12/2003 Takeda et al.
(Continued)

FOREIGN PATENT DOCUMENTS

JP 10-4529 1/1998
(Continued)

OTHER PUBLICATIONS

European Search Report dated May 11, 2010, for corresponding European Patent Application No. EP 08 74 0141.

*Primary Examiner* — Stephen Sherman
(74) *Attorney, Agent, or Firm* — Harness, Dickey & Pierce, P.L.C.

(57) ABSTRACT

In one embodiment of the present invention, a liquid crystal panel driving apparatus is disclosed which sequentially receives pieces of video data for one data signal line, (i) prepares a data string by sorting, in order of outputting, a plurality of pieces of video data inputted in a predetermined period while adding a piece of dummy data to a predetermined position, (ii) assigns one horizontal scanning period to an output of a piece of video data while assigning a dummy scanning period to an output of a piece of dummy data, and (iii) sets one horizontal scanning period shorter than an interval of inputting of pieces of video data. This makes it possible to suppress an increase in vertical display period even though a piece of dummy data is added to inputted video data while a dummy scanning period is assigned thereto.

41 Claims, 23 Drawing Sheets

U.S. PATENT DOCUMENTS

| | | | | |
|---|---|---|---|---|
| 6,724,452 | B1 | 4/2004 | Takeda et al. | |
| 6,781,586 | B1 | 8/2004 | Ohta | |
| 7,167,224 | B1 | 1/2007 | Takeda et al. | |
| 7,224,421 | B1 | 5/2007 | Takeda et al. | |
| 7,304,703 | B1 | 12/2007 | Takeda et al. | |
| 2001/0043178 | A1 | 11/2001 | Okuzono et al. | |
| 2003/0038766 | A1 | 2/2003 | Lee et al. | |
| 2003/0227429 | A1 | 12/2003 | Shimoshikiryo | |
| 2004/0119924 | A1 | 6/2004 | Takeda et al. | |
| 2004/0150604 | A1 | 8/2004 | Okuzono et al. | |
| 2004/0150612 | A1 | 8/2004 | Okuzono et al. | |
| 2004/0257320 | A1* | 12/2004 | Wang et al. | 345/87 |
| 2005/0110737 | A1 | 5/2005 | Hosotani | |
| 2005/0122441 | A1 | 6/2005 | Shimoshikiryoh | |
| 2005/0213015 | A1 | 9/2005 | Shimoshikiryo | |
| 2006/0007094 | A1 | 1/2006 | Kang et al. | |
| 2006/0041805 | A1 | 2/2006 | Song | |
| 2006/0256271 | A1 | 11/2006 | Shimoshikiryo | |
| 2007/0064187 | A1 | 3/2007 | Takeda et al. | |
| 2007/0126679 | A1 | 6/2007 | Oh et al. | |
| 2008/0106660 | A1 | 5/2008 | Kitayama et al. | |
| 2008/0165314 | A1 | 7/2008 | Takeda et al. | |
| 2008/0303997 | A1 | 12/2008 | Takeda et al. | |
| 2009/0046048 | A1 | 2/2009 | Shimoshikiryoh | |

FOREIGN PATENT DOCUMENTS

| | | |
|---|---|---|
| JP | 11-352938 | 12/1999 |
| JP | 2000-250496 | 9/2000 |
| JP | 2001-51252 | 2/2001 |
| JP | 2001-134753 | 5/2001 |
| JP | 2006-235434 | 9/2006 |
| WO | WO 2008/139693 | 11/2008 |
| WO | WO 2008/139695 | 11/2008 |
| WO | WO 2009/047941 | 4/2009 |

* cited by examiner

FIG. 6

| INPUT SIDE : HtotalX=2200, HdispX=1920, HblankX=280 | | | | | | |
|---|---|---|---|---|---|---|
| NUMBER OF VIDEO DATA IN ONE GROUP (NUMBER OF LINE) | TOTAL INPUT CLOCK OF ONE GROUP (2200×20) | NUMBER OF DUMMY SCANNING PERIOD IN ONE GROUP | HORIZONTAL SCANNING PERIOD | | DUMMY SCANNING PERIOD | |
| | | | HdispY | HblankY | DdispY | DblankY |
| 20 | 44000 | 1 | 1920 | 1 | 1920 | 3660 |
| 20 | 44000 | 1 | 1920 | 2 | 1920 | 3640 |
| 20 | 44000 | 1 | 1920 | 3 | 1920 | 3620 |
| 20 | 44000 | 1 | 1920 | 100 | 1920 | 1680 |
| 20 | 44000 | 1 | 1920 | 101 | 1920 | 1660 |
| 20 | 44000 | 1 | 1920 | 102 | 1920 | 1640 |
| 20 | 44000 | 1 | 1920 | 150 | 1920 | 680 |
| 20 | 44000 | 1 | 1920 | 151 | 1920 | 660 |
| 20 | 44000 | 1 | 1920 | 152 | 1920 | 640 |
| 20 | 44000 | 1 | 1920 | 174 | 1920 | 200 |
| 20 | 44000 | 1 | 1920 | 175 | 1920 | 180 |
| 20 | 44000 | 1 | 1920 | 176 | 1920 | 160 |
| 20 | 44000 | 1 | 1920 | 180 | 1920 | 80 |
| 20 | 44000 | 1 | 1920 | 181 | 1920 | 60 |
| 20 | 44000 | 1 | 1920 | 182 | 1920 | 40 |
| 20 | 44000 | 1 | 1920 | 183 | 1920 | 20 |
| 20 | 44000 | 1 | 1920 | 184 | 1920 | 0 |

FIG. 11

| HtotalX(INPUT SIDE)=2200, HdispY(OUTPUT SIDE)=1920 | | | | | | |
|---|---|---|---|---|---|---|
| M | a = NUMBER OF DUMMY SCANNING PERIOD | B' | D=HtotalY | E | F | D+F=DtotalY |
| 30 | 1 | 2129.03 | 2129 | 65999 | 1 | 2130 |
| 30 | 2 | 2062.5 | 2062 | 65984 | 8 | 2070 |
| 30 | 3 | 2000 | 2000 | 66000 | 0 | 2000 |
| 30 | 5 | 1885.7 | | | | IMPOSSIBLE |

| HtotalX(INPUT SIDE)=2200, HdispY(OUTPUT SIDE)=1920 | | | | | | |
|---|---|---|---|---|---|---|
| M | a = NUMBER OF DUMMY SCANNING PERIOD | B' | D=HtotalY | E | F | D+F=DtotalY |
| 40 | 1 | 2146.3 | 2146 | 87986 | 14 | 2160 |
| 40 | 2 | 2095.2 | 2095 | 87990 | 5 | 2100 |
| 40 | 4 | 2000 | 2000 | 88000 | 0 | 2000 |
| 40 | 5 | 1955.5 | 1955 | 87975 | 5 | 1960 |
| 40 | 6 | 1913.04 | | | | IMPOSSIBLE |

FIG. 12

| INPUT SIDE:HtotalX=2200,HdispX=1920,HblankX=280 | | | | | | |
|---|---|---|---|---|---|---|
| NUMBER M OF VIDEO DATA IN ONE GROUP (NUMBER OF LINE) | TOTAL INPUT CLOCK OF ONE GROUP (2200×40) | NUMBER OF DUMMY SCANNING PERIOD IN ONE GROUP | HORIZONTAL SCANNING PERIOD | | DUMMY SCANNINGPERIOD | |
| | | | HdispY | HblankY | DdispY | DblankY |
| 40 | 88000 | 3 | 1920 | 100 | 1920 | 480 |
| 40 | 88000 | 3 | 1920 | 106 | 1920 | 400 |
| 40 | 88000 | 3 | 1920 | 112 | 1920 | 320 |
| 40 | 88000 | 3 | 1920 | 118 | 1920 | 240 |
| 40 | 88000 | 3 | 1920 | 124 | 1920 | 160 |
| 40 | 88000 | 3 | 1920 | 130 | 1920 | 80 |
| 40 | 88000 | 3 | 1920 | 136 | 1920 | 0 |

LIQUID CRYSTAL PANEL DRIVING APPARATUS, LIQUID CRYSTAL DISPLAY APPARATUS, METHOD FOR DRIVING LIQUID CRYSTAL DISPLAY APPARATUS, DRIVE CONDITION SETTING PROGRAM, AND TELEVISION RECEIVER

TECHNICAL FIELD

The present invention relates to a dummy scanning period of a liquid crystal display apparatus.

BACKGROUND ART

Liquid crystal display apparatuses have merits such as high definition, thinness, lightness in weight, and low power consumption. Recently, market scale of liquid crystal display apparatuses has been rapidly expanding. A liquid crystal display apparatus carries out AC driving in which a polarity of a signal potential is periodically (e.g., frame by frame) reversed. The AC driving causes a flicker. In view of this, a conventional liquid crystal display apparatus adopts (i) V-line inversion driving in which any two pixels adjacent in the line direction (i.e., in a direction in which scanning signal lines are provided) have respective signal potentials whose polarities are reverse to each other or (ii) dot inversion driving (1h/1v inversion driving) in which (a) any two pixels adjacent in a line direction have respective signal potentials whose polarities are reverse to each other and (b) any two pixels adjacent in a column direction (i.e., in a direction in which data signal lines are provided) have respective signal potentials whose polarities are reverse to each other.

In case of the V-line inversion driving, unfortunately, a flicker can be recognized by a viewer. On the other hand, the dot inversion driving has problems such as a decrease in pixel charging rate and/or an increase in power consumption, due to a high inversion frequency of a data signal line. In view of this, as is disclosed in Patent Literature 1 for example, block inversion driving (nh/1v inversion driving) is proposed in which a polarity of a signal potential is reversed for every plural pixels arrayed in the column direction whereas a polarity of a signal potential is reversed pixel by pixel for those arrayed in the line direction. According to the block inversion driving, a polarity of a signal potential to be supplied to a data signal line is reversed for every plural horizontal scanning periods. This allows an improvement in pixel charging rate, and also allows suppression of power consumption and an amount of heat, in contrast to the dot inversion driving.

As illustrated in FIG. 24, Patent Literature 1 further discloses an arrangement in which a horizontal period which comes immediately after a polarity reversal is carried out by the block inversion driving is set to a dummy scanning period during which only a pre-charge is carried out (i.e., a full charge is not carried out). According to the arrangement, data (n+2) is supplied immediately after a polarity reversal during two horizontal scanning periods, i.e., a dummy scanning period and one horizontal scanning period. This allows an increase in charging ratio of a pixel to which the data (n+2) is supplied.

CITATION LIST

Patent Literature 1

Japanese Patent Application Publication, Tokukai, No. 2001-51252 A (Publication Date: Feb. 23, 2001)

SUMMARY OF INVENTION

Note however that a dummy scanning period which has a length equal to one horizontal scanning period is added every polarity reversal, i.e., every fifth horizontal scanning period (see FIG. 24). It follows that one vertical display period (=1 frame period−vertical blanking period) becomes long whereas one vertical blanking period becomes short. Therefore, it is necessary to prepare data to be supplied in consideration of such an increase in vertical display period. In addition, the addition of the dummy scanning periods causes an increase in time lag between inputting and outputting of data. This leads to a problem of an increase in memory (buffer) usage.

An object of the present invention is to suppress an increase in vertical display period although horizontal scanning periods and dummy scanning periods are provided in a liquid crystal display apparatus.

A liquid crystal panel driving apparatus of the present invention is a liquid crystal panel driving apparatus which sequentially receives, at intervals, pieces of video data each corresponding to one data signal line, wherein: the pieces of video data are divided into groups to each of which a predetermined number of pieces of video data belong and in each of which a piece of dummy data is added in a predetermined position; a signal potential corresponding to the piece of dummy data is outputted during a dummy scanning period; a signal potential corresponding to each of the predetermined number of pieces of video data is outputted during one horizontal scanning period; and the one horizontal scanning period is set to be shorter than each of the intervals at which said apparatus sequentially receives the pieces of video data. The liquid crystal panel driving apparatus, for example, (i) selects (arranges) pieces of video data so as to group the pieces of video data into a group containing a plurality of pieces of video data, and (ii) adds a piece of dummy data in a predetermined position in the group.

According to the arrangement, one horizontal scanning period in which a signal potential corresponding to a piece of video data is outputted is reduced shorter than an interval of inputting of pieces of video data (i.e., a horizontal scanning period assigned to a piece of video data to be inputted). A sum of such reduction makes it possible to provide dummy scanning periods for outputting pieces of dummy data. This makes it possible to suppress an increase in vertical display period even though a piece of dummy data is added to inputted video data while a dummy scanning period is assigned to the piece of dummy data. Further, this makes it possible to suppress an increase in time lag between inputting and outputting of data, and thereby reduce a memory (buffer) usage.

The liquid crystal panel driving apparatus can be arranged such that, in each of the groups, a product of (i) the number of the predetermined number of pieces of video data and (ii) any one of the intervals at which said apparatus sequentially receives the pieces of video data is equal to a sum of (I) a total of dummy scanning periods during each of which a corresponding piece of dummy data is outputted and (II) a total of horizontal scanning periods during which the respective predetermined number of pieces of video data are outputted.

This makes it possible to provide (add) dummy scanning periods without changing (i.e., without reducing) vertical scanning periods. This eliminates an increase in time lag between inputting and outputting of data. Therefore, the arrangement makes it possible to further reduce a memory (buffer) usage.

The liquid crystal panel driving apparatus can be arranged such that the piece of dummy data is added at a head of each of the groups.

The liquid crystal panel driving apparatus can be arranged such that, (i) each of signal potentials of respective predetermined number of pieces of video data and (ii) a signal potential of a piece of dummy data have a first polarity in one of adjacent ones of the groups, whereas (a) each of signal potentials of respective predetermined number of pieces of video data and (b) a signal potential of a piece of dummy data have a second polarity in the other of the adjacent ones of the groups. According to the arrangement, a desired piece of dummy data is added to, e.g., a head of each of data groups. This makes it possible to prevent a decrease in charging rate of a data signal line due to blunting of a waveform caused immediately after a polarity reversal.

The liquid crystal panel driving apparatus can be arranged such that the signal potentials corresponding to the respective predetermined number of pieces of video data are outputted to a corresponding data signal line in sync with scans of the respective scanning signal lines corresponding to the respective pieces of video data; the signal potential corresponding to the piece of dummy data is outputted to the data signal line (i) in sync with a scan of a scanning signal line corresponding to a piece of video data whose signal potential is outputted immediately after the signal potential of the dummy data or (ii) between (a) a scan of a scanning signal line corresponding to a piece of video data whose signal potential is outputted immediately before the signal potential of the dummy data and (b) a scan of a scanning signal line corresponding to a piece of video data whose signal potential is outputted immediately after the signal potential of the dummy data; and the respective scanning signal lines are subjected to progressive scanning in accordance with how the predetermined number of pieces of video data are arranged in each of the groups.

The liquid crystal panel driving apparatus can arranged such that the signal potentials corresponding to the respective predetermined number of pieces of video data are outputted to a corresponding data signal line in sync with scans of the respective scanning signal lines corresponding to the respective pieces of video data; the signal potential corresponding to the piece of dummy data is outputted to the data signal line (i) in sync with a scan of a scanning signal line corresponding to a piece of video data whose signal potential is outputted immediately after the signal potential of the dummy data or (ii) between (a) a scan of a scanning signal line corresponding to a piece of video data whose signal potential is outputted immediately before the signal potential of the dummy data and (b) a scan of a scanning signal line corresponding to a piece of video data whose signal potential is outputted immediately after the signal potential of the dummy data; and the respective scanning signal lines are subjected to interlaced scanning in accordance with how the predetermined number pieces of video data are arranged in each of the groups.

The liquid crystal panel driving apparatus may generate, in accordance with the horizontal scanning period and the dummy scanning period, (i) a signal for controlling (a) timing at which the signal potentials corresponding to the respective predetermined number of pieces of video data are outputted and (b) timing at which the signal potential of the piece of dummy data is outputted, and (ii) a signal for controlling timing at which gate ON pulses are outputted to the respective scanning signal lines corresponding to the predetermined number of pieces of video data.

A liquid crystal panel driving apparatus of the present invention: sequentially receives, at intervals, pieces of video data each corresponding to one data signal line, wherein: the pieces of video data are divided into groups to each of which a predetermined number of pieces of video data belong and in each of which (i) a signal potential corresponding to a predetermined piece of video data is outputted during a period of sum of one horizontal scanning period and at least one dummy scanning period and (ii) each of signal potentials corresponding to respective pieces of video data other than the predetermined piece of video data is outputted during one horizontal scanning period, and the one horizontal scanning period is set shorter than each of the intervals at which said apparatus sequentially receives the pieces of video data. The liquid crystal panel driving apparatus, for example, selects (arranges) pieces of video data so as to group the pieces of video data into a group containing a plurality of pieces of video data. The intervals (i.e., intervals of inputting of pieces of data) are regular in one frame.

According to the arrangement, one horizontal scanning period in which a signal potential corresponding to a piece of video data is outputted is reduced shorter than an interval of inputting of pieces of video data (i.e., a horizontal scanning period assigned to a piece of video data to be inputted). A sum of such reduction makes it possible to secure periods to be assigned to dummy scanning periods. This makes it possible to suppress an increase in vertical display period while providing (adding) dummy scanning periods. Further, this makes it possible to suppress an increase in time lag between inputting and outputting of data, and thereby reduce a memory (buffer) usage.

The liquid crystal panel driving apparatus is preferably arranged such that, in each of the groups, a product of (i) the number of the predetermined number of pieces of video data and (ii) any one of the intervals at which said apparatus sequentially receives the pieces of video data is equal to a sum of (I) a total of horizontal scanning periods during each of which the signal potential corresponding to the predetermined piece of video data is outputted, (II) a total of at least one dummy scanning period during which the signal potential corresponding to the predetermined piece of video data is outputted, and (III) a total of horizontal scanning periods during which the each of signal potentials corresponding to the respective pieces of video data other than the predetermined piece of video data is outputted. This makes it possible to provide (add) dummy scanning periods without changing (i.e., without reducing) vertical scanning periods. This eliminates an increase in time lag between inputting and outputting of data. Therefore, the arrangement makes it possible to further reduce a memory (buffer) usage.

The liquid crystal panel driving apparatus can be arranged such that signal potentials of respective predetermined number of pieces of video data have a first polarity (e.g., a positive polarity) in one of adjacent ones of the groups, whereas signal potentials of respective predetermined number of pieces of video data have a second polarity (e.g., a negative polarity) in the other of the adjacent ones of the groups. The arrangement makes it possible to reduce an effect of blunting of a signal waveform caused immediately after a polarity reversal.

The liquid crystal panel driving apparatus of the present invention can be arranged such that signal potentials corresponding to the respective predetermined number of pieces of video data are outputted to a corresponding data signal line in sync with scans of the respective scanning signal lines corresponding to the respective pieces of video data; and the respective scanning signal lines are subjected to progressive scanning in accordance with how the predetermined number of pieces of video data are arranged in each of the groups.

The liquid crystal panel driving apparatus of the present invention can be arranged such that signal potentials corresponding to the respective predetermined number of pieces of video data are outputted to a corresponding data signal line in sync with scans of the respective scanning signal lines corresponding to the respective pieces of video data; and the respective scanning signal lines are subjected to interlaced scanning in accordance with how the predetermined number of pieces of video data are arranged in each of the groups.

A liquid crystal panel driving apparatus of the present invention: receives pieces of video data each corresponding to one data signal line, wherein: the pieces of video data are divided into data strings in each of which (i) a predetermined number of pieces of video data, which are supplied in a predetermined period, are arranged in an order in which they are outputted and (ii) a piece of dummy data is added in a predetermined position; each of the predetermined number of pieces of video data is outputted during one horizontal scanning period and the piece of dummy data is outputted during one dummy scanning period; and one horizontal scanning period is set shorter than each of intervals at which the predetermined number of pieces of video data are supplied.

The liquid crystal panel driving apparatus can be arranged such that the predetermined period is equal to a sum of (i) a product of the number of the predetermined number of pieces of video data in each of the data strings and one horizontal scanning period and (ii) a product of the number of pieces of dummy data in a corresponding one of the data strings and a dummy scanning period.

The liquid crystal panel driving apparatus can be arranged such that the predetermined period is equal to a period found by subtracting a vertical blanking period from one vertical scanning period.

The liquid crystal panel driving apparatus can be arranged such that each of the data strings is made up of a plurality of groups arranged in chronological order; each of the plurality of groups has a piece of dummy data as a first piece of data, and a plurality of pieces of video data, as subsequent pieces of data; and signal potentials of a piece of dummy data and a plurality of pieces of video data have a first polarity in one of adjacent ones of the groups, whereas signal potentials of a piece of dummy data and a plurality of pieces of video data have a second polarity in the other of the adjacent ones of the groups.

The liquid crystal panel driving apparatus can be arranged such that the order in which the predetermined number of pieces of video data are arranged complies with progressive scanning or interlaced scanning which are carried out with respect to the scanning signal lines.

The liquid crystal panel driving apparatus can be arranged such that the signal potentials corresponding to the respective predetermined number of pieces of video data are outputted to a corresponding data signal line in sync with scans of the respective scanning signal lines corresponding to the respective pieces of video data; and the signal potential corresponding to the piece of dummy data is outputted to the data signal line between (a) a scan of a scanning signal line corresponding to a piece of video data whose signal potential is outputted immediately before the signal potential of the dummy data and (b) a scan of a scanning signal line corresponding to a piece of video data whose signal potential is outputted immediately after the signal potential of the dummy data.

The liquid crystal panel driving apparatus can be arranged such that a signal potential corresponding to the piece of dummy data is equal to a signal potential corresponding to a piece of video data whose signal potential is outputted immediately after the signal potential of the piece of dummy data.

The liquid crystal panel driving apparatus of the present invention can be arranged such that the predetermined piece of video data includes a first piece of video data and another piece of video data, in each of the groups.

The liquid crystal panel driving apparatus of the present invention can be arranged such that said dummy scanning period and said at least one dummy scanning period are each set to be shorter than each of the intervals at which said apparatus sequentially receives the pieces of video data.

The liquid crystal panel driving apparatus of the present invention can be arranged such that said dummy scanning period and said at least one dummy scanning period are each set to be equal to one horizontal scanning period. According to the arrangement, each dummy scanning period and each one horizontal scanning period are equal to each other. This makes it possible to simplify signal processing or an arrangement for the signal processing.

The liquid crystal panel driving apparatus of the present invention can be arranged such that said dummy scanning period and said at least one dummy scanning period are each set to be shorter than one horizontal scanning period. This makes it possible to secure long one horizontal scanning period. This is advantageous to increasing in charging rate of a pixel.

The liquid crystal panel driving apparatus of the present invention can be arranged such that said dummy scanning period and said at least one dummy scanning period are each set to be longer than one horizontal scanning period. This realizes an arrangement which is advantageous to increasing a charging rate of a data signal line immediately after a polarity reversal, in an arrangement in which a polarity of a signal potential is reversed group by group.

The liquid crystal panel driving apparatus of the present invention can be arranged such that the following steps (a) through (e) are carried out so as to find, for each of the groups, a combination of: (i) the number of dummy scanning periods; (ii) one horizontal scanning period; and (iii) a dummy scanning period, in a case where each of the groups has M horizontal scanning periods; the steps are: (a) determining whether or not B is not less than a predetermined value, where "a" indicates a variable which is an integer of not less than 1, A is a sum of M and "a", and B is found by dividing, by A, a product of M and any one of the intervals at which said apparatus sequentially receives the pieces of video data, (b) determining whether or not F is an integer in a case where B is determined in the step (a) to be not less than the predetermined value, where D is an integer obtained by rounding down fractions below decimal point of B, E is a product of D and A, P is obtained by subtracting E from the product of M and any one of the intervals at which said apparatus sequentially receives the pieces of video data, and F is found by dividing P by "a," (c) determining whether or not "a" is not less than a minimal required number of dummy scanning periods in a case where F is determined in the step (b) to be an integer, where the minimal required number is obtained from a charging characteristic at M, (d) storing a combination of: a dummy scanning period of "a"; one horizontal scanning period of D; and a dummy scanning period of a sum of D and F, in a case where "a" is determined in the step (c) to be not less than the minimal required number of the dummy scanning periods, and (e) changing "a", and selecting one of combinations obtained by carrying out repeatedly the steps (a) through (d).

A drive condition setting program of the present invention causes the liquid crystal panel driving apparatus to operate, the drive condition setting program causing a computer to carry out the steps (a) through (e).

A method of the present invention for driving a liquid crystal display apparatus which sequentially receives, at intervals, pieces of video data each corresponding to one data signal line, said method includes the steps of: dividing the pieces of video data into groups to each of which a predetermined number of pieces of video data belong and in each of which a piece of dummy data is added in a predetermined position; outputting a signal potential corresponding to the piece of dummy data during a dummy scanning period; outputting a signal potential corresponding to each of the predetermined number of pieces of video data during one horizontal scanning period; and setting the one horizontal scanning period shorter than each of the intervals at which said apparatus sequentially receives the pieces of video data. According to the method, for example, pieces of video data are selected (arranged) so as to be grouped into a group containing a plurality of pieces of video data while a piece of dummy data is added to a predetermined position in the group.

The method for driving a liquid crystal display apparatus preferably arranged such that, in each of the groups, a sum of (i) a total of dummy scanning periods during each of which a corresponding piece of dummy data is outputted and (ii) a total of horizontal scanning periods during which the each of the predetermined number of pieces of video data is outputted is equal to a product of (I) the number of the predetermined number of pieces of video data and (II) any one of the intervals at which said apparatus sequentially receives the pieces of video data.

A method of the present invention for driving a liquid crystal display apparatus which sequentially receives, at intervals, pieces of video data each corresponding to one data signal line, said method includes the steps of: dividing the pieces of video data into groups to each of which a predetermined number of pieces of video data belong and in each of which (i) a signal potential corresponding to a predetermined piece of video data is outputted during a period of sum of one horizontal scanning period and at least one dummy scanning period and (ii) each of signal potentials corresponding to respective pieces of video data other than the predetermined piece of video data is outputted during one horizontal scanning period, and setting the one horizontal scanning period shorter than each of the intervals at which said apparatus sequentially receives the pieces of video data. According to the method, for example, pieces of video data are selected (arranged) so as to be grouped into a group containing a plurality of pieces of video data.

The method for driving a liquid crystal display apparatus is preferably arranged such that, in each of the groups, a sum of (I) a total of horizontal scanning periods during each of which the signal potential corresponding to the predetermined piece of video data is outputted, (II) a total of at least one dummy scanning period during which the signal potential corresponding to the predetermined piece of video data is outputted, and (III) a total of horizontal scanning periods during which the each of signal potentials corresponding to the respective pieces of video data other than the predetermined piece of video data is outputted is equal to a product of (i) the number of the predetermined number of pieces of video data and (ii) any one of the intervals at which said apparatus sequentially receives the pieces of video data.

A method of the present invention for driving a liquid crystal display apparatus which sequentially receives pieces of video data each corresponding to one data signal line, said method includes the steps of: dividing the pieces of video data into data strings in each of which (i) a predetermined number of pieces of video data, which are supplied in a predetermined period, are arranged in an order in which they are outputted and (ii) a piece of dummy data is added in a predetermined position; outputting each of the predetermined number of pieces of video data during one horizontal scanning period; outputting the piece of dummy data during one dummy scanning period; and setting one horizontal scanning period shorter than each of intervals at which the predetermined number of pieces of video data are supplied. In this case, the method can be further arranged such that the predetermined period is equal to a sum of (i) a product of the number of the predetermined number of pieces of video data in each of the data strings and one horizontal scanning period and (ii) a product of the number of pieces of dummy data in a corresponding one of the data strings and a dummy scanning period.

The liquid crystal display apparatus of the present invention includes a liquid crystal panel and the liquid crystal panel driving apparatus for driving the liquid crystal panel.

A television receiver of the present invention includes: the liquid crystal display apparatus; and a tuner section for receiving television broadcast.

As described above, the liquid crystal panel driving apparatus of the present invention makes it possible to suppress an increase in vertical display period even though the liquid crystal panel driving apparatus adds a piece of dummy data to inputted video data while assigning a dummy scanning period to the piece of dummy data. In addition, the liquid crystal panel driving apparatus makes it possible to suppress an increase in time lag between inputting and outputting of data. As a result, a memory (buffer) usage can be reduced.

BRIEF DESCRIPTION OF DRAWINGS

FIG. 6 is a table showing example settings of a horizontal scanning period and a dummy scanning period of the liquid crystal display apparatus of the present invention.

FIG. 11 is a table showing example settings of a horizontal scanning period and a dummy scanning period which are determined by steps of FIG. 10.

FIG. 12 is a table showing example of settings of a horizontal scanning period and a dummy scanning period which are found by a recalculation.

REFERENCE SIGNS LIST

VtotalX: (input side) One horizontal scanning period (1 frame period)
VtotalY: (output side) One horizontal scanning period (1 frame period)
VdispX: (input side) Vertical display period
VdispY: (output side) Vertical display period
VblankX: (input side) Vertical blanking period
VblankY: (output side) Vertical blanking period
HtotalX: (input side) One horizontal scanning period (an interval between data inputs)
HtotalY: (output side) One horizontal scanning period
HdispX: (input side) Horizontal display period
HdispY: (output side) Horizontal display period
HblankX: (input side) Horizontal blanking period
HblankY: (output side) Horizontal blanking period
DtotalY: Dummy scanning period
DdispY: Dummy display period
DblankY: Dummy blanking period

DESCRIPTION OF EMBODIMENTS

The following description deals with an embodiment of the present invention.

Figure 16:
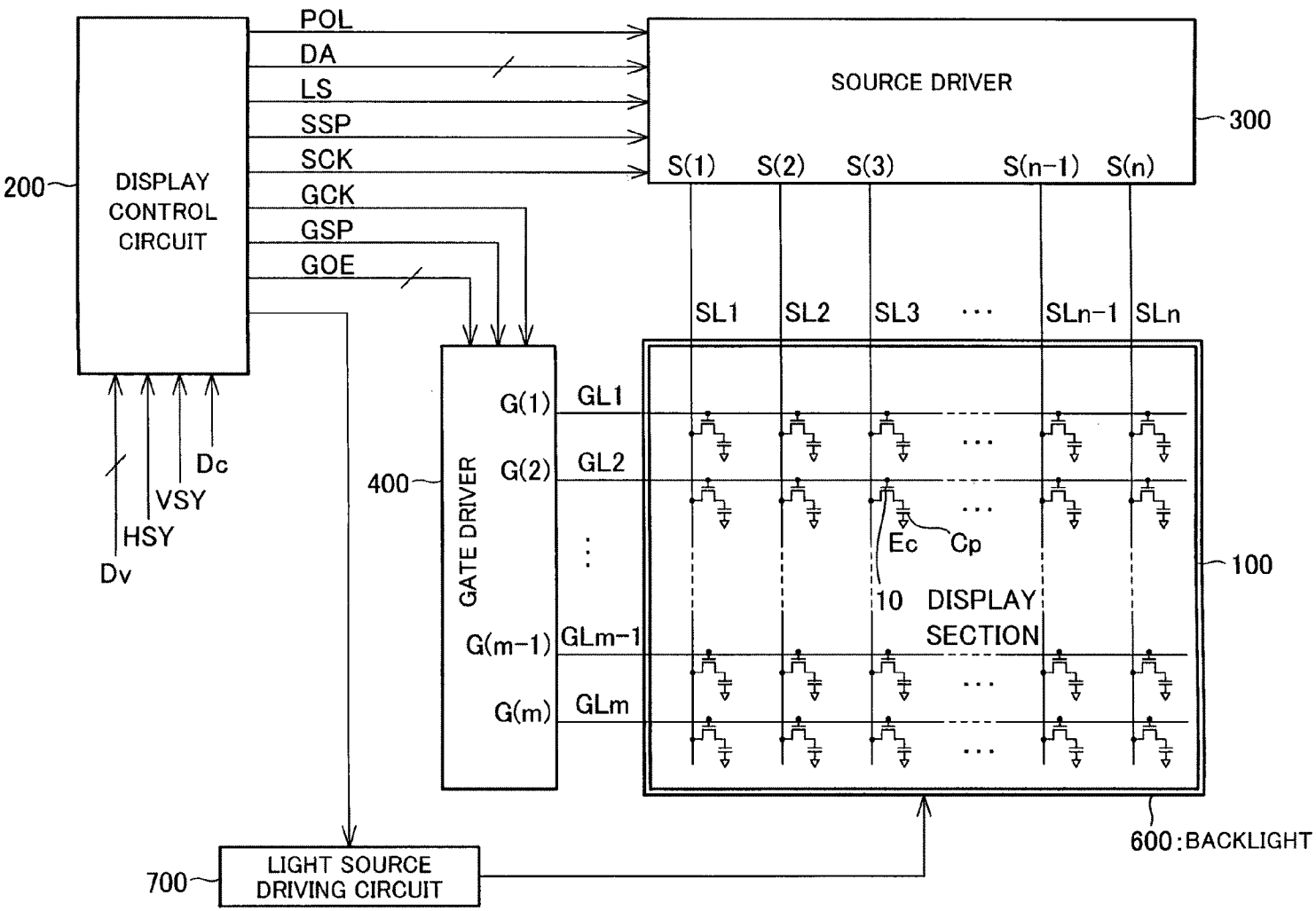
FIG. 16 is a plan view illustrating an arrangement of the liquid crystal display apparatus of the present invention.

FIG. 16 is a block diagram illustrating an arrangement of a liquid crystal display apparatus of the present invention. As illustrated in FIG. 16, the liquid crystal display apparatus includes a source driver 300, a gate driver 400, a liquid crystal panel 100, a backlight 600, a light source driving circuit 700 for driving the backlight 600, and a display control circuit 200 for controlling the source driver 300, the gate driver 400, and the light source driving circuit 700. A liquid crystal panel driving apparatus is constituted by whole or part of the source driver 300, the gate driver 400, and the display control circuit 200.

The liquid crystal panel 100 includes a plurality of ("m") gate lines (scanning signal lines) GL1 through GLm, a plurality of ("n") source lines (data signal lines) SL1 through SLn each of which intersects with the gate lines GL1 through GLm, and a plurality of (m×n) pixels provided at respective intersections of the gate lines GL1 through GLm and the source lines SL1 through SLn. A direction in which the gate lines extend is referred to as line direction, and a direction in which the source lines extend is referred to as column direction.

Each of the plurality of pixels includes: a TFT 10 which has (i) a gate terminal connected to a gate line GLj running through a corresponding one of the intersections and (ii) a source terminal connected to a source line SLi running through the corresponding one of the intersections; a pixel electrode connected to a drain terminal of the TFT 10; a part of a common electrode Ec which part corresponds to the pixel electrode; and a liquid crystal layer sandwiched between the pixel electrode and the common electrode Ec. A pixel capacitor Cp is defined by a liquid crystal capacitor formed between the pixel electrode and the common electrode Ec. In order to retain and control an electric potential of the pixel electrode, An auxiliary capacitor (retention capacitor) is provided parallel to the liquid crystal capacitor. The auxiliary capacitor is formed between an auxiliary capacitor line and the pixel electrode or a capacitor electrode connected to the auxiliary capacitor line.

The source driver 300 applies a signal potential to a pixel electrode in each of the plurality of pixels via corresponding source line and TFT, in accordance with an image to be displayed. A power supply circuit (not illustrated) supplies a predetermined electric potential Vcom to the common electrode Ec. This causes a voltage to be applied to liquid crystal in accordance with an electric potential difference between the signal potential of the pixel electrode and the predetermined potential Vcom of the common electrode Ec. A light transmittance of the liquid crystal layer is controlled, so that image display is carried out.

The backlight 600 is a plane illumination device for illuminating the liquid crystal panel 100 from behind. The backlight 600 is constituted by for example a cold-cathode tube serving as a linear light source and a light guide plate. The backlight 600 is driven by the light source driving circuit 700 to be turned on. As a result, each of the plurality of pixels in the liquid crystal panel 100 is irradiated with light emitted from the backlight 600.

The display control circuit 200 receives from an external signal source: a digital video signal Dv indicative of an image to be displayed; a horizontal sync signal HSY and a vertical sync signal VSY which correspond to the digital video signal Dv; and a control signal Dc for controlling a display operation. In accordance with the signals Dv, HSY, VSY, and Dc thus received, the display control circuit 200 generates and outputs signals, such as a data start pulse signal SSP, a data clock signal SCK, a latch strobe signal (data signal application control signal) LS, a polarity reversal signal POL, a digital image signal DA (signal corresponding to the digital video signal Dv) indicative of an image to be displayed, a gate start pulse signal GSP, a gate clock signal GCK, and a gate driver output control signal (scanning signal output control signal) GOE, for causing the liquid crystal panel 100 (display section) to display an image indicated by the digital video signal Dv.

More specifically, in an internal memory of the display control circuit 200, a timing adjustment etc. are carried out with respect to the digital video signal Dv as needed, and the digital video signal Dv is then outputted from the display control circuit 200 as the digital image signal DA. The data clock signal SCK is generated as a signal having pulses corresponding to respective pixels of an image indicated by the digital image signal DA. The data start pulse signal SSP is generated as a signal which has an High level (H level) only during a predetermined period every horizontal scanning period, in accordance with the horizontal sync signal HSY.

The gate start pulse signal GSP (GSPa, GSPb) is generated as a signal which has an H level only during a predetermined period every frame period (every vertical scanning period), in accordance with the vertical sync signal VSY. The gate clock signal GCK (GCKa, GCKb) is generated in accordance with the horizontal sync signal HSY. The latch strobe signal LS and the gate driver output control signal GOE (GOEa, GOEb) are generated in accordance with the horizontal sync signal HSY and the control signal Dc.

Among the signals thus generated in the display control circuit 200, the digital image signal DA, the latch strobe signal LS, the data start pulse signal SSP, the data clock signal SCK, and the polarity reversal signal POL are supplied to the source driver 300, whereas the gate start pulse signal GSP, the gate clock signal GCK, and the gate driver output control signal GOE are supplied to the gate driver 400.

The source driver 300 sequentially generates data signals S(1) through S(n) every horizontal scanning period as analog voltages, corresponding to gradation values of respective pixels on a corresponding horizontal scanning line, of an image indicated by the digital image signal DA in accordance with the digital image signal DA, the data start pulse signal SSP, the data clock signal SCK, the latch strobe signal LS, and the polarity reversal signal POL. The data signals S(1) through S(n) thus generated are applied to the source lines SL1 through SLn, respectively.

The gate driver 400 generates scanning signals G(1) through G(m) in accordance with the gate start pulse signal GSP (GSPa, GSPb), the gate clock signal GCK (GCKa, GCKb), and the gate driver output control signal GOE (GOEa, GOEb). The scanning signals G(1) through G(m) thus generated are applied to the gate lines GL1 through GLm, respectively. This causes the gate lines GL1 through GLm to be selectively driven. The gate lines GL1 through GLm can be selectively driven by applying, as the scanning signals G(1) through G(m), gate ON pulses whose pulse widths are respective selection periods to the gate lines GL1 through GLm.

The source driver 300 thus drives the source lines SL1 through SLn of the liquid crystal panel 100, and the gate driver 400 thus drives the gate lines GL1 through GLm of the liquid crystal panel 100. This causes a signal potential of a source line SLi is applied to a corresponding pixel electrode via a corresponding TFT 10 connected to a selected gate line GLj (i=1 through n; j=1 through m). Thus, a voltage is applied to a liquid crystal layer of each of the plurality of pixels in response to the digital image signal DA. A transmittance of light emitted from the backlight 600 in each of the plurality of pixels is controlled by the voltage thus applied. The image indicated by the digital video signal Dv is ultimately displayed over the plurality of pixels.

Examples of display methods encompass progressive scanning and interlaced scanning. According to the progressive scanning, the gate lines GL1 through GLm are sequentially selected line by line from an uppermost one to a lowermost one while one screen image is being displayed, i.e., during one frame period. According to the interlaced scanning, the gate lines GL1 through GLm are divided into a plurality of groups to each of which a predetermined number of gate lines belong so that the plurality of groups are separated from each other by a predetermined number of gate lines, and the plurality of groups are sequentially scanned. In a case where the gate lines GL1 through GLm are divided into two groups so as to alternately belong to one and the other of the two groups, during one frame period, odd-numbered ones of or even-numbered ones of the gate lines GL1 through GLm are sequentially selected from their uppermost one to their lowermost one, and then, the even-numbered ones of or the odd-numbered ones of the gate lines GL1 through GLm are sequentially selected from their uppermost one to their lowermost one.

The following description deals with an arrangement in which (i) pieces of video data are selected (arranged) in the order in which they are inputted, (ii) the pieces of video data are divided into a plurality of groups to which a predetermined number of pieces of video data (i.e., pieces of video data corresponding to one source line) belong, (iii) at least one piece of dummy data is added at a head of each of the plurality of groups, (iv) signal potentials corresponding to respective pieces of data (the pieces of video data and the at least one piece of dummy data) are outputted, in sync with progressive scanning of scanning signal lines, to respective source lines in the order in which the pieces of data are arranged, (v) a signal potential corresponding to each of the plurality of pieces of video data is outputted during one horizontal period, and a signal potential corresponding to each of the at least one piece of dummy data is outputted during a dummy scanning period, and (vi) polarities of the signal potentials are reversed group by group. The arrangement can realize block inversion driving (nh/1v inversion driving) in which polarities of respective signal potentials to be outputted to a plurality pixels arranged in any adjacent columns are reversed column by column. Note that polarities of respective signal potentials to be outputted to any adjacent pixels arranged in the line direction are reversed pixel by pixel.

Figure 13:
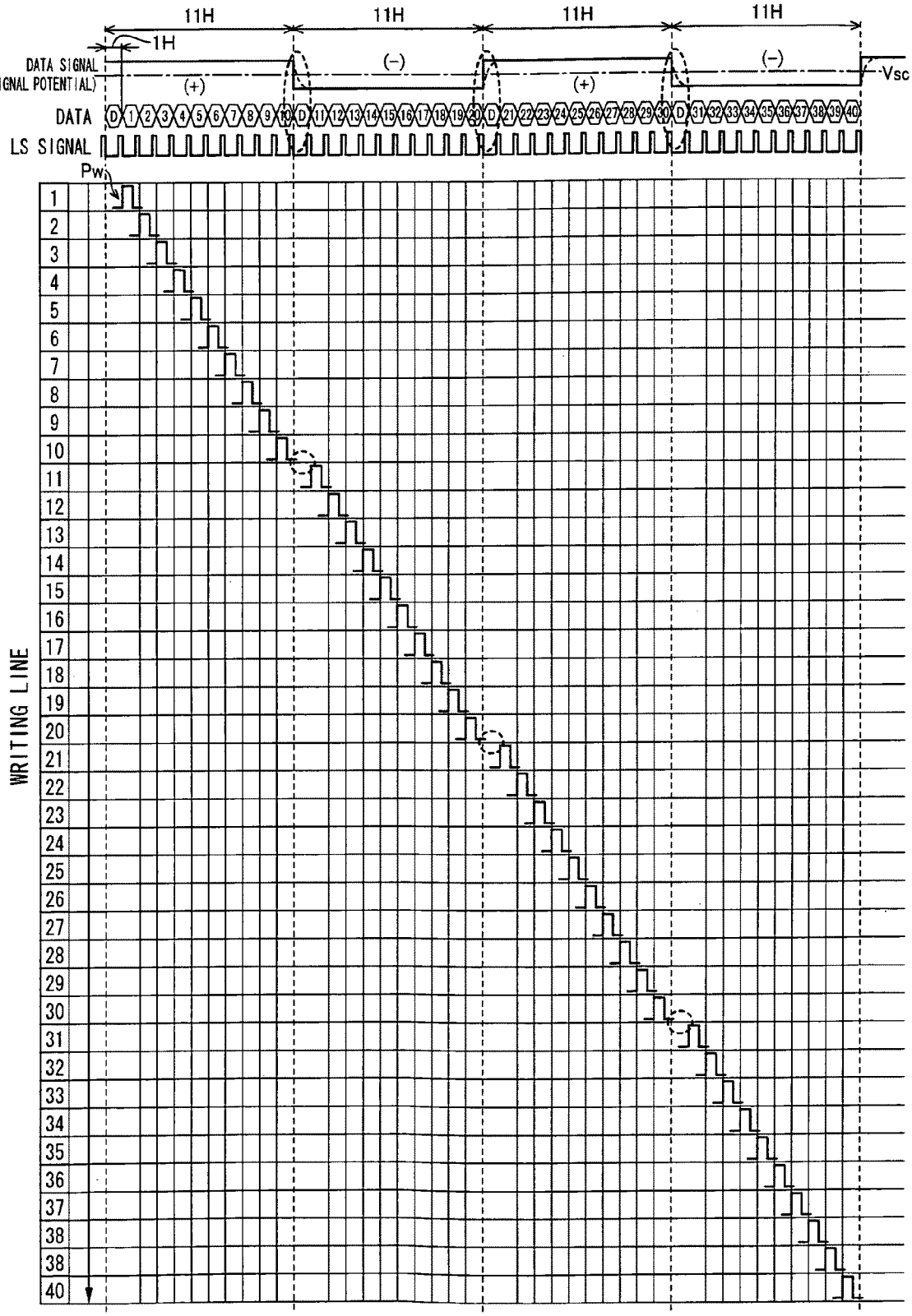
FIG. 13 is a timing chart illustrating a method for driving the liquid crystal display apparatus of the present invention.

FIG. 13 illustrates (i) data strings to be outputted, (ii) waveforms of signal potentials corresponding to respective pieces of data, and (iii) a timing chart of a latch strobe signal LS and gate ON pulses (data write pulses) Pw, obtained in a case where (a) pieces of video data are divided, in the order in which they are inputted, into groups to each of which 10 pieces of video data belong and (b) a piece of dummy data is added at a head of each of the groups, and (c) polarities of respective signal potentials are reversed group by group (reversal cycle=one dummy scanning period+10 horizontal scanning periods). FIG. 13 horizontally expresses elapsed time, and vertically expresses the gate lines (writing lines) GL1 through GLm to each of which a gate ON pulse is applied.

In this case, pieces of video data to be inputted are arrayed in the order numbered: 1, 2, 3, 4, 5, 6, 7, 8, 9, 10, 11, 12, 13, 14, 15, 16, 17, 18, 19, 20, 21, 22, . . . . Here, a piece of video data which corresponds to an N-th gate line is given number N. In a dummy data adding circuit of the display control circuit 200, (i) the pieces of video data are divided into groups for example as follows: 1, 2, 3, . . . 8, 9, and 10; 11, 12, 13, . . . 18, 19, and 20; 21, 22, . . . and (ii) a piece of dummy data is added at a head of each of the groups. With the arrangement, the pieces of data (the pieces of video data and the piece of dummy data) are outputted in the following order: <D>, <1>, <2>, <3>, <4>, <5>, <6>, <7>, <8>, <9>, and <10>; <D>, <11>, <12>, <13>, <14>, <15>, <16>, <17>, <18>, <19>, and <20>; <D>, <21>, <22>, . . . (see FIG. 13). Here, a piece of video data which corresponds to an N-th gate line is represented by <N>, and a piece of dummy data is represented by <D>. Signal potentials, which have a positive polarity and correspond to the respective pieces of data (the pieces of video data and the piece of dummy data), i.e., correspond to <D>, <1>, <2>, . . . and <10>, are supplied to one source line in this order. Then, signal potentials, which have a negative polarity and correspond to the respective pieces of data: i.e., correspond to <D>, <11>, <12>, . . . and <20>, are supplied to the one source line in this order. Then, signal potentials which have the positive polarity and correspond to the respective pieces of data: <D>, <21>, <22> . . . are supplied to the one source line in this order.

It should be noted that any piece of data can be set as the piece of dummy data <D>. For example, the piece of dummy data <D> can be identical with a piece of video data whose signal potential is outputted immediately after the signal potential of the piece of dummy data <D>. Alternatively, the piece of dummy data <D> can be set to a piece of data whose signal potential is higher than that of a piece of video data whose signal potential is outputted immediately after the signal potential of the piece of dummy data <D>, from a viewpoint of an improvement in charging effect of a source line.

A waveform of a signal potential becomes blunt immediately after a polarity of the signal potential is reversed. In view of this, according to the arrangement, a dummy scanning period is secured immediately after a polarity reversal so that a predetermined signal potential (a signal potential corresponding to a piece of dummy data) is applied to a source line. This makes it possible to charge the source line during the dummy scanning period. This makes it possible to write a desired signal potential (an electric potential corresponding to a piece of video data) to a pixel during a horizontal scanning period which comes after a dummy scanning period. This makes it possible to prevent display unevenness which occurs every 10 lines due to blunting of a waveform of a signal potential which blunting is caused immediately after each polarity reversal.

As described above, the liquid crystal display apparatus of the present invention is arranged such that: one horizontal scanning period HtotalY in actual outputting is shorter than one horizontal scanning period HtotalX set to a video data string to be inputted so that a vertical display period of one frame does not vary (i.e., so that a vertical blanking period VblankX set to video data strings to be inputted is equal to a vertical blanking period VblankY in actual outputting), even though, as described above, (i) a piece of dummy data is added to each of the groups which contains 10 pieces of video data and (ii) pieces of dummy data are outputted during respective dummy scanning periods. This is explained below.

Figure 1:
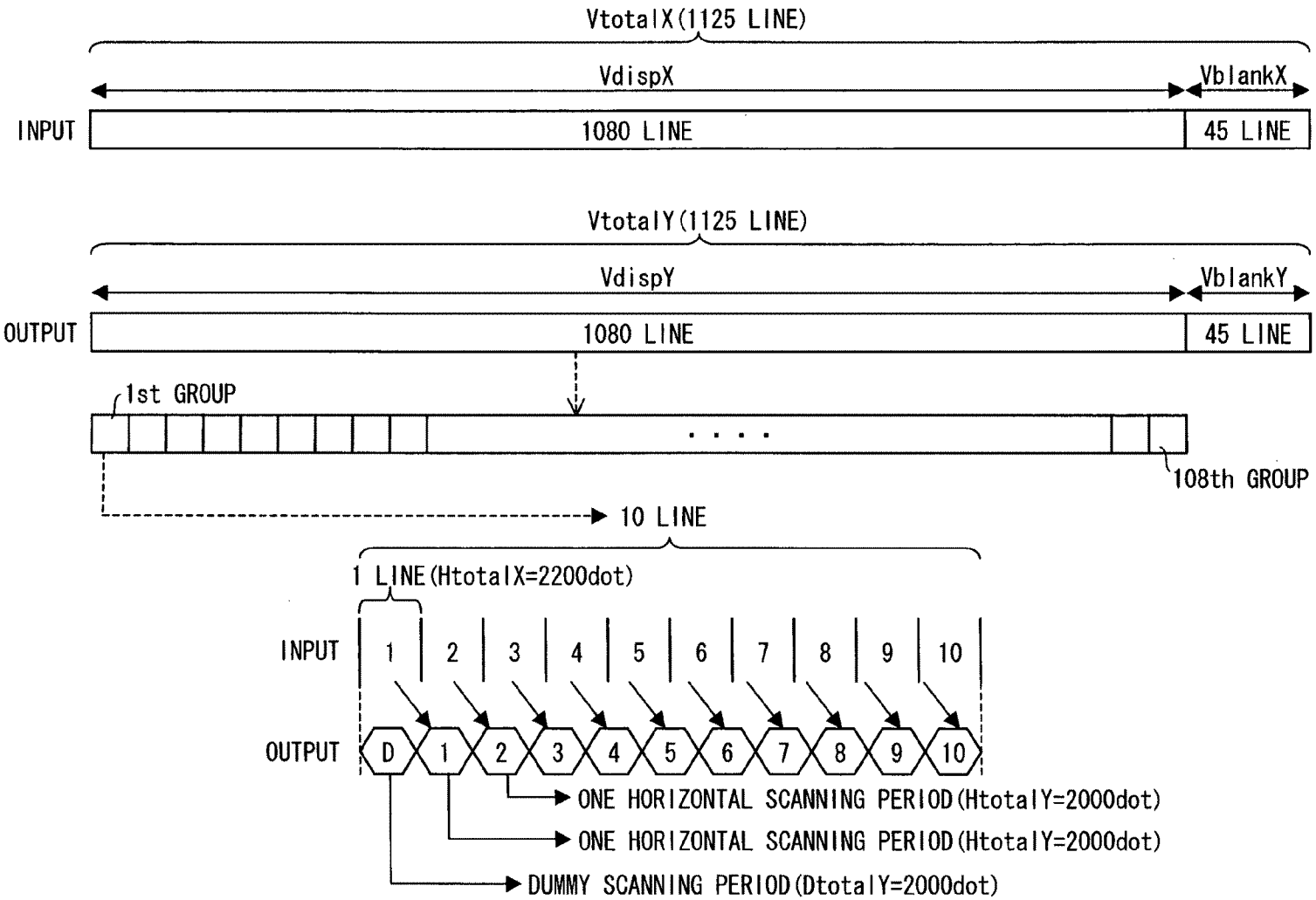
FIG. 1 is a schematic view illustrating a method for driving a liquid crystal display apparatus of the present invention.

FIG. 1 illustrates (i) video data strings to be inputted, (ii) video data strings to be outputted, and (iii) relations among respective output periods of pieces of data, for a case where (i) pieces of video data are divided into a plurality of groups to each of which 10 pieces of video data (i.e., pieces of video data corresponding to one source line) belong, (ii) one piece of dummy data is added at a head of each of the plurality of groups, (iii) signal potentials corresponding to respective pieces of data (the pieces of video data and the one piece of dummy data) are outputted, in sync with progressive scanning of scanning signal lines, to respective source lines in the order in which the pieces of data are arranged, (iv) a signal potential corresponding to each of the plurality of pieces of video data is outputted during one horizontal period, and a signal potential corresponding to each of the at least one piece of dummy data is outputted during a dummy scanning period, and (v) polarities of the signal potentials are reversed group by group (reversal cycle=one dummy scanning period+10 horizontal scanning periods). Note that the video data strings to be supplied are set in conformity with a standard specification of Full HD (High Definition), i.e., frequency of dot clock=148.5 MHz; one frame period VtotalX=vertical display period VdispX (1080 lines)+vertical blanking period VblankX (45 lines); one horizontal scanning period HtotalX (intervals at which pieces of video data are inputted)=2200 dots; and one horizontal scanning period HtotalX=horizontal display period HdispX (1920 dots)+horizontal blanking period HblankX (280 dots).

According to the liquid crystal display apparatus of the present embodiment, (i) one horizontal scanning period HtotalY during which a piece of video data is actually outputted corresponds to 2000 dots and (ii) a dummy scanning period DtotalY during which a piece of dummy data is actually outputted also corresponds to 2000 dots, although one horizontal scanning period HtotalX during which each of pieces of video data in a video data string is inputted is set to correspond to 2200 dots (see FIG. 1). Accordingly, in a case where 10 pieces of video data for 10 gate lines belong to each of the groups, (i) a total of the horizontal scanning periods during of which 10 pieces of video data are inputted is set to correspond to 22000 dots=2200 dots×10 and (ii) a total period, found by adding (a) a piece of dummy period during which a piece of dummy data is outputted to (b) a total of the horizontal scanning periods during which 10 pieces of video data are actually outputted, corresponds to 22000 dots=(2000 dots×10)+(2000 dots×1). Thus, the above (i) and (ii) are equal to each other.

Figure 2:
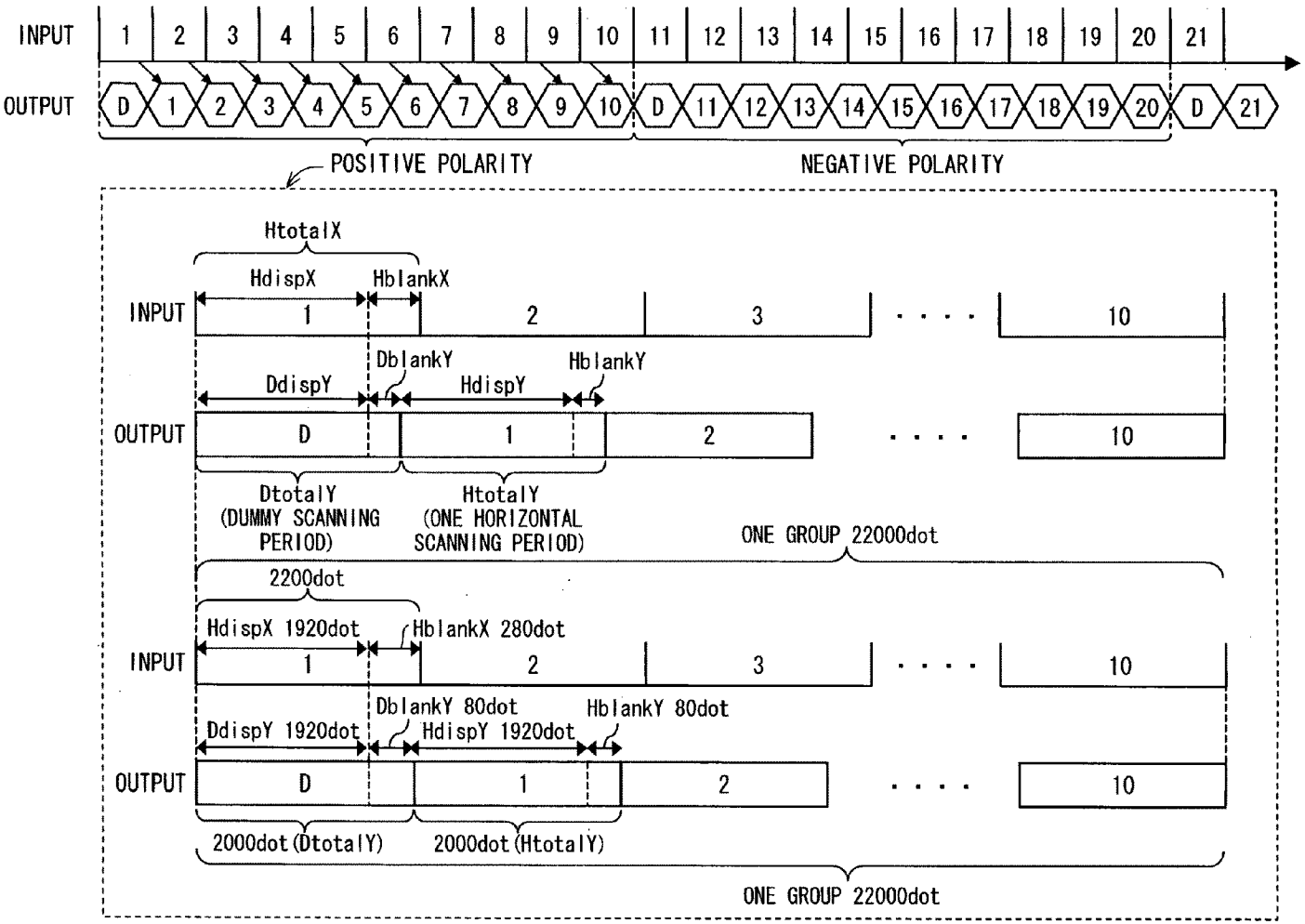
FIG. 2 is a schematic view illustrating the method of FIG. 1 in more detail.

More specifically, as illustrated in FIG. 2, the one horizontal scanning period HtotalY corresponding to 2000 dots is less than the one horizontal scanning period HtotalX corresponding to 2200 dots. Here, the one horizontal scanning period HtotalY corresponding to 2000 dots are made up of (i) a horizontal display period HdispY corresponding to 1920 dots and (ii) a horizontal blanking period HblankY corresponding to 80 dots. In contrast, the one horizontal scanning period HtotalX=horizontal display period HdispX (corresponding to 1920 dots)+horizontal blanking period HblankX (corresponding to 280 dots). Further, the dummy scanning period DtotalY corresponding to 2000 dots is less than the HtotalX, and the dummy scanning period DtotalY is made up of a dummy display period DdispY corresponding to 1920 dots and a dummy blanking period DblankY corresponding to 80 dots.

A signal potential is supplied to a source line throughout one horizontal scanning period (HtotalY) including a horizontal blanking period (HblankY). A writing operation is carried out to a pixel during a period in which a transistor of the pixel turns ON in sync with a corresponding horizontal scanning period (i.e., during a period in which a gate ON pulse is supplied to a corresponding gate line). In addition, a signal potential is supplied to a source line also throughout a dummy scanning period (DtotalY) including a dummy blanking period (DblankY). Unlike the arrangement illustrated in FIG. 13, a writing operation can be carried out to a pixel during a dummy scanning period.

In FIG. 13, a signal potential corresponding to a piece of data (video data or dummy data) is latched in sync with a falling edge of the latch strobe signal. Then, a signal potential corresponding to the next piece of data (video data or dummy data) is latched in sync with the next falling edge of the latch strobe signal. A similar operation is carried out during each of the dummy scanning periods. A width of a gate ON pulse Pw is set to be less than that of one horizontal scanning period HtotalY, for example.

With the arrangement, it is possible for a horizontal display period HdispX to be identical to a horizontal display period HdispY. This makes it possible to add one piece of dummy scanning period every 10 horizontal scanning periods, without (i) changing a dot clock, (ii) increasing a vertical display period of a liquid crystal display apparatus, and (iii) reducing a vertical blanking period (i.e., while maintaining the following relations: VdispX=VdispY; VblankX=VblankY).

The arrangement also allows an advantage in easy signal processing or an easy arrangement for the signal processing. This is because a dummy scanning period DtotalY is equal (2000 dots) to a one horizontal scanning period HtotalY.

The display control circuit 200 (liquid crystal panel driving apparatus) determines a combination of: (i) a total number of horizontal scanning periods (the number of pieces of video data) in one group; (ii) a total number of dummy scanning periods (the number of pieces of dummy data) in one group, (iii) one horizontal scanning period HtotalY, and (iv) a dummy scanning period DtotalY. In accordance with the combination, the display control circuit 200 generates the signals (POL, LS, SSP, SCK, GCK, GSP, and GOE) etc. The display control circuit 200 also adds a piece of dummy data to a supplied piece of video data.

According to the arrangement, a piece of dummy data is added to pieces of video data which are sequentially supplied. However, the present embodiment is not limited to this. This can be replaced by an arrangement in which a dummy scanning period is secured for example by omitting one latch pulse, without adding a piece of dummy data (i.e., while maintaining a video data string as supplied). According to the arrangement, it should be noted that a same piece of video data is supplied to a source line during a dummy scanning period and a subsequent one horizontal scanning period.

Figure 3:
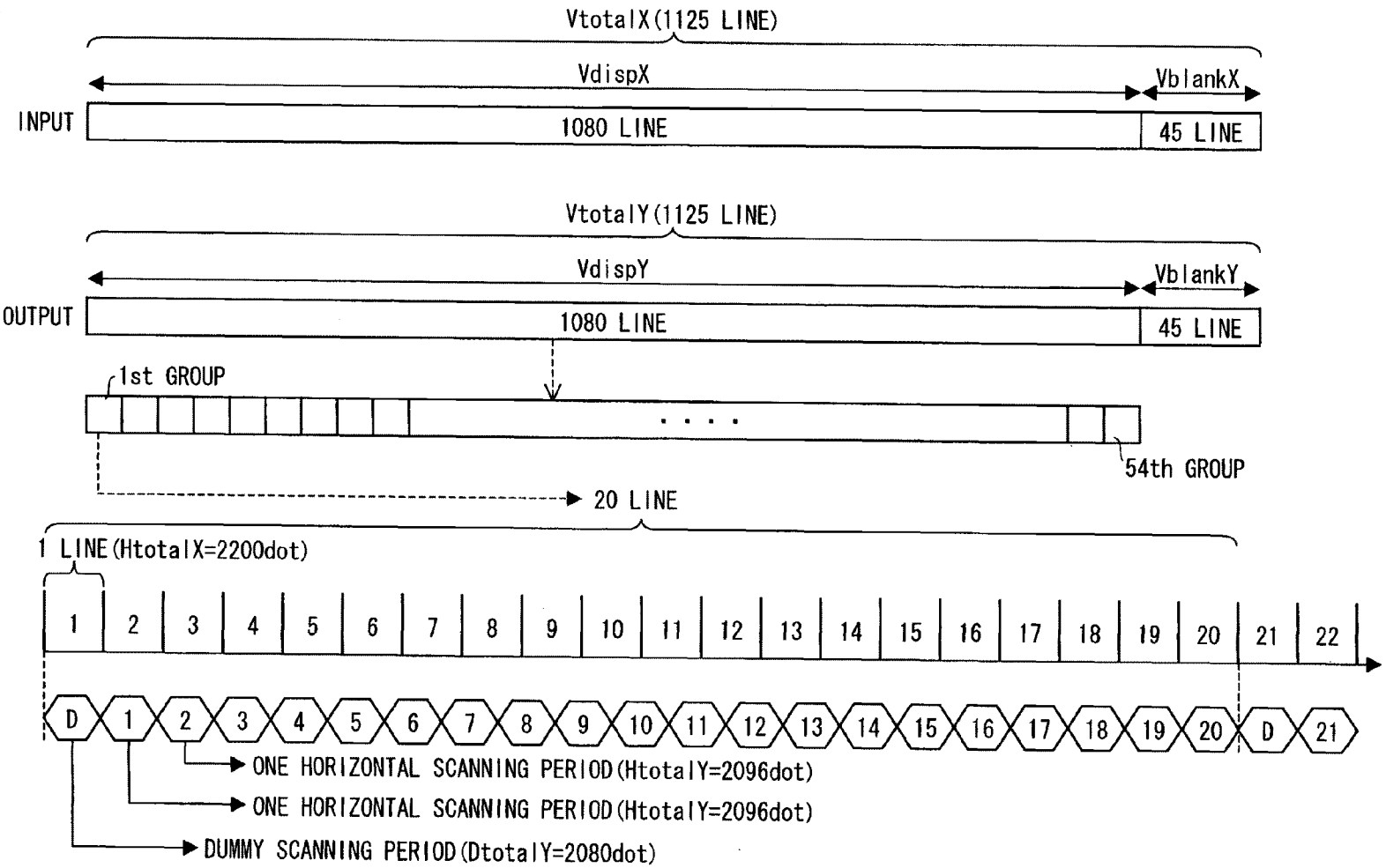
FIG. 3 is a schematic view illustrating another method for driving the liquid crystal display apparatus of the present invention.

FIG. 3 illustrates (i) video data strings to be inputted, (ii) video data strings to be outputted, and (iii) relations among respective output periods of pieces of data, for a case where (i) pieces of video data are divided into a plurality of groups to each of which 20 pieces of video data (i.e., pieces of video data corresponding to one source line) belong, (ii) one piece of dummy data is added at a head of each of the plurality of groups, (iii) signal potentials corresponding to respective pieces of data (the pieces of video data and the one piece of dummy data) are outputted, in sync with progressive scanning of scanning signal lines, to respective source lines in the order in which the pieces of data are arranged, (iv) a signal potential corresponding to each of the plurality of pieces of video data is outputted during one horizontal period, and a signal potential corresponding to each of the at least one piece of dummy data is outputted during a dummy scanning period, and (v) polarities of the signal potentials are reversed group by group (reversal cycle=one dummy scanning period+20 horizontal scanning periods).

As illustrated in FIG. 3, the liquid crystal display apparatus is arranged such that a vertical display period VdispX (1080 lines) assigned to video data strings to be inputted is equal to a vertical display period VdispY in actual outputting even though a piece of dummy data is added to each group containing 20 pieces of video data while a dummy scanning period is assigned to each piece of dummy data. This equalizes a vertical blanking period VblankX (45 lines) assigned to the video data strings to be supplied and a vertical blanking period VblankY in actual outputting. For this arrangement, one horizontal scanning period HtotalY in actual outputting is set to correspond to 2096 dots, and a dummy scanning period DtotalY is set to correspond to 2080 dots, although one horizontal scanning period HtotalX during which each piece of video data is inputted is set to correspond to 2200 dots. Accordingly, (i) a total of horizontal scanning periods assigned to each group containing 20 pieces of video data (i.e., video data corresponding to 20 gate lines) to be inputted is: 44000 dots=2200 dots×20, and (ii) a period found by adding a piece of dummy scanning period to a total of horizontal scanning periods assigned to an actual output of each group is: 44000 dots=(2096 dots×20)+(2080 dots×1). Thus, (i) and (ii) are equal to each other.

Figure 4:
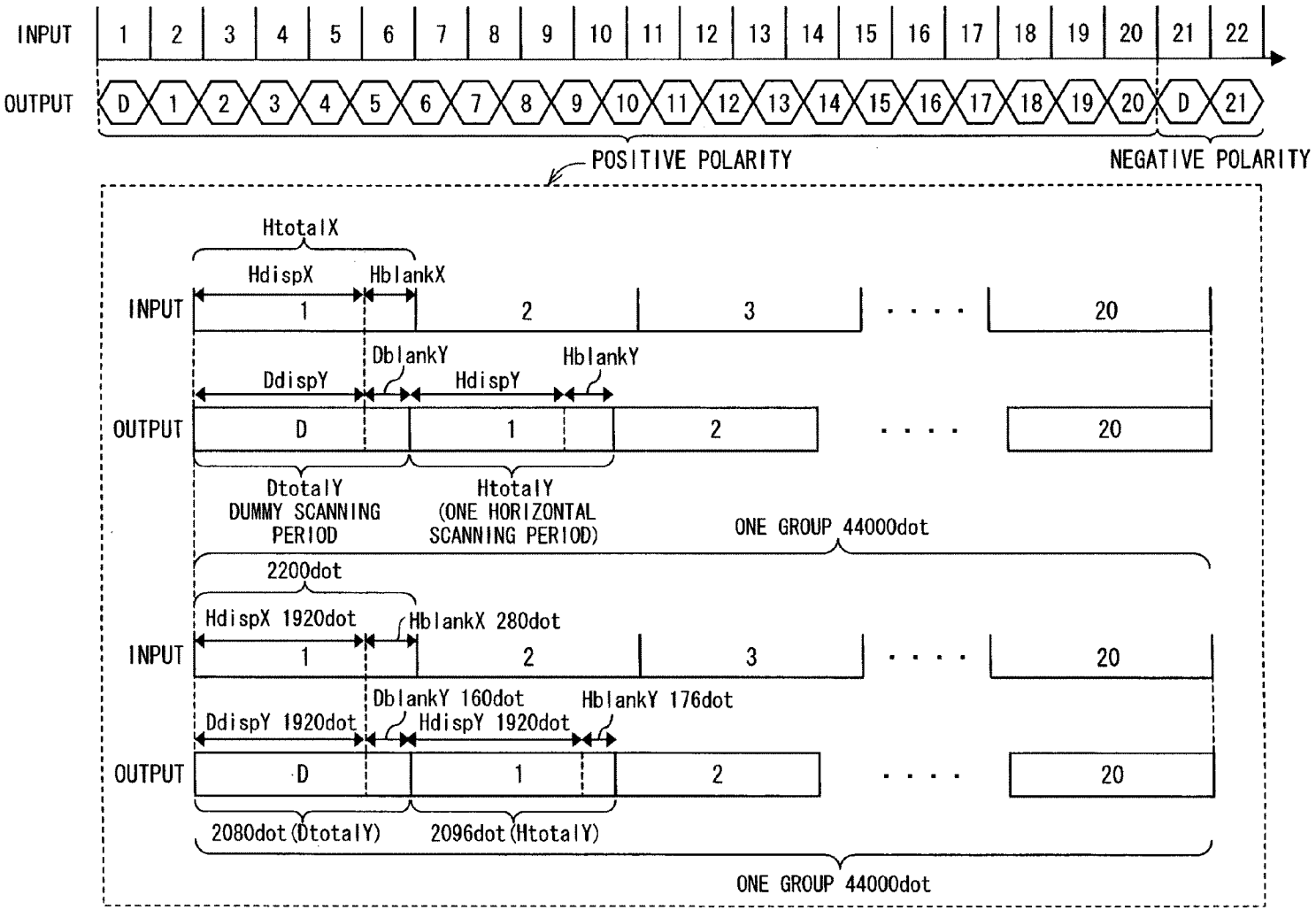
FIG. 4 is a schematic view illustrating the method of FIG. 3 in more detail.

More specifically, as illustrated in FIG. 4, the one horizontal scanning period HtotalY corresponding to 2096 dots is less than the one horizontal scanning period HtotalX corresponding to 2200 dots. Here, the one horizontal scanning period HtotalY corresponding to 2096 dots are made up of (i) a horizontal display period HdispY corresponding to 1920 dots and (ii) a horizontal blanking period HblankY corresponding to 176 dots. In contrast, the one horizontal scanning period HtotalX=horizontal display period HdispX (corresponding to 1920 dots)+horizontal blanking period HblankX (corresponding to 280 dots). Further, the dummy scanning period DtotalY corresponding to 2080 dots is less than the HtotalX, and the dummy scanning period DtotalY is made up of a dummy display period DdispY corresponding to 1920 dots and a dummy blanking period DblankY corresponding to 160 dots.

A signal potential is supplied to a source line throughout one horizontal scanning period (HtotalY) including a horizontal blanking period (HblankY). A writing operation is carried out to a pixel during a period in which a transistor of the pixel turns ON in sync with a corresponding horizontal scanning period (i.e., during a period in which a gate ON pulse is supplied to a corresponding gate line). In addition, a signal potential is supplied to a source line also throughout a dummy scanning period (DtotalY) including a dummy blanking period (DblankY). Unlike the arrangement illustrated in FIG. 13, a writing operation can be carried out to a pixel during a dummy scanning period.

With the arrangement, it is possible for a horizontal display period HdispX to be identical to a horizontal display period HdispY. This makes it possible to add one piece of dummy scanning period every 20 horizontal scanning periods, without (i) changing a dot clock, (ii) increasing a vertical display period of a liquid crystal display apparatus, and (iii) reducing a vertical blanking period (i.e., while maintaining the following relations: VdispX=VdispY; VblankX=VblankY).

In addition, according to the arrangement, a dummy scanning period DtotalY corresponds to 2080 dots, and one horizontal scanning period HtotalY corresponds to 2096 dots. As such, it is possible to secure a long horizontal scanning period. This is advantageous to the charging of a pixel.

Figure 5:
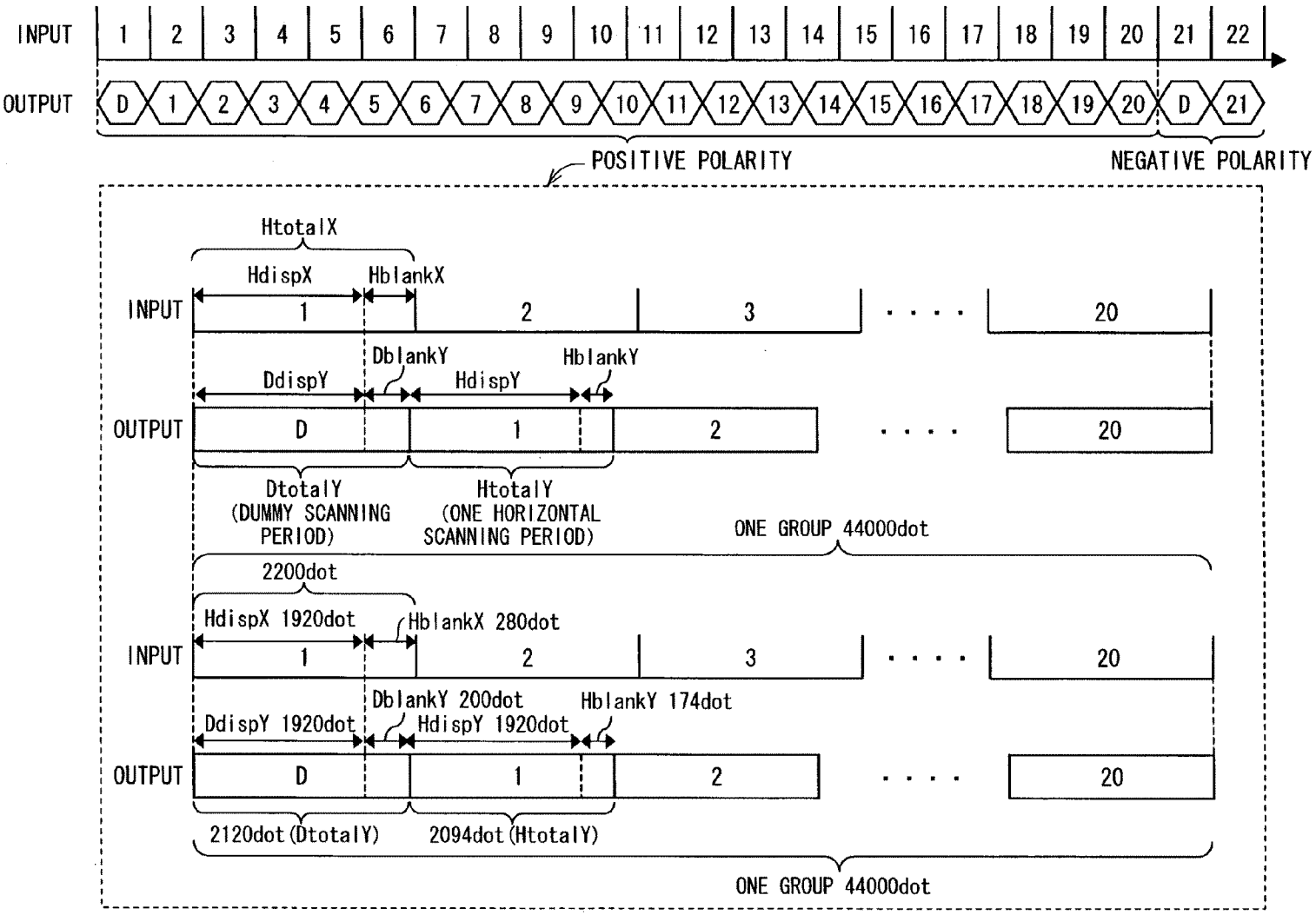
FIG. 5 is a schematic view illustrating still another method for driving the liquid crystal display apparatus of the present invention.

In a case where a piece of dummy data is added to each group containing 20 pieces of video data, and a dummy scanning period is assigned to each piece of the dummy data, as illustrated in FIG. 5, it can be arranged such that, in actual outputting, one horizontal scanning period HtotalY corresponds to 2094 dots and a dummy scanning period DtotalY corresponds to 2120 dots, although one horizontal scanning period HtotalX during which each video data string is inputted corresponds to 2200 dots. Accordingly, (i) a total of horizontal scanning periods assigned to each group containing 20 pieces of video data (i.e., video data corresponding to 20 gate lines) to be inputted is: 44000 dots=2200 dots×20, and (ii) a period found by adding a piece of dummy scanning period to a total of horizontal scanning periods assigned to an actual output of each group is: 44000 dots=(2094 dots×20)+(2120 dots×1). Thus, (i) and (ii) are equal to each other. More specifically, as illustrated in FIG. 5, the one horizontal scanning period HtotalY corresponding to 2094 dots is less than the one horizontal scanning period HtotalX corresponding to 2200 dots. Here, the one horizontal scanning period HtotalY corresponding to 2094 dots are made up of (i) a horizontal display period HdispY corresponding to 1920 dots and (ii) a horizontal blanking period HblankY corresponding to 174 dots. In contrast, the one horizontal scanning period HtotalX=horizontal display period HdispX (corresponding to 1920 dots)+horizontal blanking period HblankX (corresponding to 280 dots). Further, the dummy scanning period DtotalY corresponding to 2120 dots is less than the HtotalX, and the dummy scanning period DtotalY is made up of a dummy display period DdispY corresponding to 1920 dots and a dummy blanking period DblankY corresponding to 200 dots.

Also in this case, it is possible for a horizontal display period HdispX to be identical to a horizontal display period HdispY. This makes it possible to add one piece of dummy scanning period every 20 horizontal scanning periods, without (i) changing a dot clock, (ii) increasing a vertical display period of a liquid crystal display apparatus, and (iii) reducing a vertical blanking period (i.e., while maintaining the following relations: VdispX=VdispY; VblankX=VblankY).

In addition, according to the arrangement, a dummy scanning period DtotalY corresponds to 2120 dots, and one horizontal scanning period HtotalY corresponds to 2094 dots. As such, it possible to secure a long dummy scanning period. This is advantageous to the charging of a source line in a case where a waveform of a signal voltage is greatly blunting after a polarity reversal.

By setting HtotalY (=HdispY+HblankY) and DtotalY (=DdispY+DblankY) to be one of combinations shown in FIG. 6, it is possible that (i) a piece of dummy data is added to each group containing 20 pieces of video data and (ii) the piece of dummy data is outputted during a dummy scanning period in a case where the one horizontal scanning period HtotalX corresponds to 2200 dots (=1920 dots (corresponding to HdispX)+280 dots (corresponding to HblankX)). Note that it is preferable that a difference between a dummy scanning period and a horizontal scanning period is small because it is possible to simplify timing adjustments with respect to other signals (e.g., a waveform of an electric potential applied to a retention capacitor line can be easily set in a case where a later described pixel division method is adopted). In view of this, it is preferable to select any one of the following shaded combinations in FIG. 6: (i) the combination of 2094 dots corresponding to HtotalY (1920 dots corresponding to HdispY+174 dots corresponding to HblankY) and 2120 dots corresponding to DtotalY (1920 dots corresponding to DdispY+200 dots corresponding to DblankY); a combination of 2095 dots corresponding to HtotalY (1920 dots corresponding to HdispY+175 dots corresponding to HblankY) and 2100 dots corresponding to DtotalY (1920 dots corresponding to DdispY+180 dots corresponding to DblankY); and the combination of 2096 dots corresponding to HtotalY (1920 dots corresponding to HdispY+176 dots corresponding to HblankY) and 2080 dots corresponding to DtotalY (1920 dots corresponding to DdispY+160 dots corresponding to DblankY).

The following description deals with an arrangement in which (i) for interlaced scanning, pieces of video data are selected (arranged) so as to alternately belong to two groups in the order in which they are inputted, (ii) the pieces of video data are divided into a plurality of groups to which a predetermined number of pieces of video data (i.e., pieces of video data corresponding to one source line) belong, (iii) at least one piece of dummy data is added at a head of each of the plurality of groups, (iv) signal potentials corresponding to respective pieces of data (the pieces of video data and the at least one piece of dummy data) are outputted, in sync with interlaced scanning of scanning signal lines (i.e., interlaced scanning in which scanning is carried out with respect to every other gate line), to respective source lines in the order in which the pieces of data are arranged, (v) a signal potential corresponding to each of the plurality of pieces of video data is outputted during one horizontal period, and a signal potential corresponding to each of the at least one piece of dummy data is outputted during a dummy scanning period, and (vi) polarities of the signal potentials are reversed group by group. The arrangement can realize dot inversion driving (1h/1v inversion driving) in which polarities of respective signal potentials to be outputted to a plurality pixels arranged in any adjacent columns are reversed pixel by pixel. Note that polarities of respective signal potentials to be outputted to any adjacent pixels arranged in the line direction are reversed pixel by pixel. According to the arrangement, a sorting circuit is provided in the display control circuit 200 illustrated in FIG. 16. The sorting circuit carries out sorting of inputted pieces of video data and addition of pieces of dummy data (This is described later).

Figure 14:
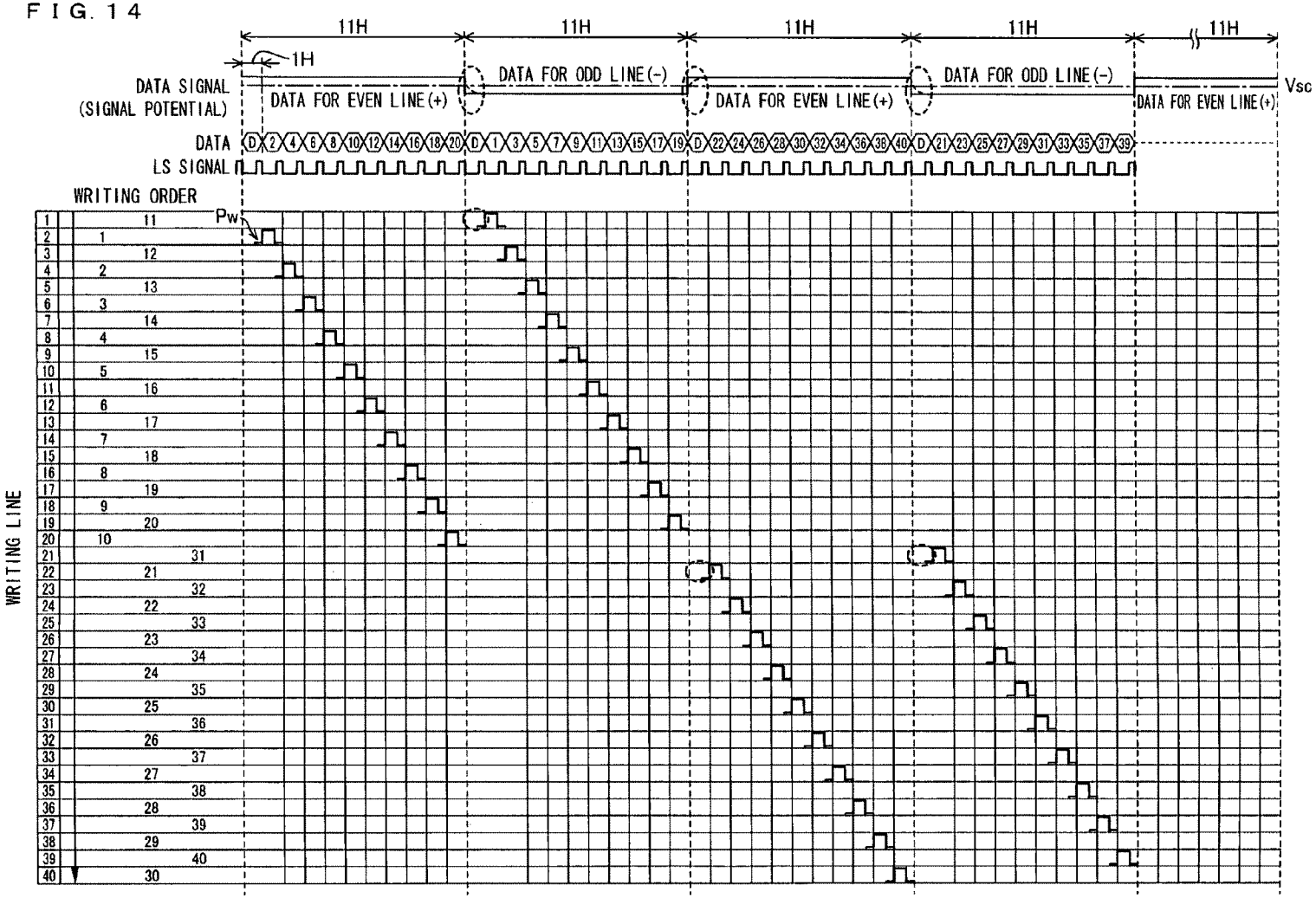
FIG. 14 is a timing chart illustrating another method for driving the liquid crystal display apparatus of the present invention.

FIG. 14 shows (i) data strings (video data and dummy data) to be supplied, (ii) waveforms of signal potentials corresponding respectively to pieces of video data, (iii) and a timing chart of a latch strobe signal LS and gate ON pulses (data write pulses) Pw, for a case where: (i) the pieces of video data are divided into a plurality of groups to which 10 pieces of video data (i.e., pieces of video data corresponding to one source line) belong, (ii) at least one piece of dummy data is added at a head of each of the plurality of groups, (iii) signal potentials corresponding to respective pieces of data (the pieces of video data and the at least one piece of dummy data) are outputted, in sync with interlaced scanning of scanning signal lines, to respective source lines in the order in which the pieces of data are arranged, (iv) a signal potential corresponding to each of the plurality of pieces of video data is outputted during one horizontal period, and a signal potential corresponding to each of the at least one piece of dummy data is outputted during a dummy scanning period, and (v) polarities of the signal potentials are reversed group by group (reversal cycle=one dummy scanning period+10 horizontal scanning periods). FIG. 14 horizontally expresses elapsed time, and vertically expresses the gate lines (writing lines) GL1 through GLm to each of which a gate ON pulse is applied.

In this case, pieces of video data (not illustrated) to be inputted are arrayed as follows: 1, 2, 3, 4, 5, 6, 7, 8, 9, 10, 11, 12, 13, 14, 15, 16, 17, 18, 19, 20, 21, 22, 23, 24 . . . , where a piece of video data N (N=1, 2, 3 . . . ) corresponds to an N-th gate line. In the sorting circuit, (i) the pieces of video data are divided into groups for example as follows: 2, 4, 6, 8, 10, 12, 14, 16, 18, and 20; 1, 3, 5, 7, 9, 11, 13, 15, 17, and 19; 22, 24 . . . and (ii) a piece of dummy data is added at a head of each of the groups. With the arrangement, the pieces of data (the pieces of video data and the piece of dummy data) are outputted in the following order: <D>, <2>, <4>, <6>, <8>, <10>, <12>, <14>, <16>, <18>, and <20>; <D>, <1>, <3>, <5>, <7>, <9>, <11>, <13>, <15>, <17>, and <19>; <D>, <22>, <24>, . . . . Here, a piece of video data which corresponds to an N-th gate line is represented by <N>, and a piece of dummy data is represented by <D>. Signal potentials, which have a positive polarity and correspond to the respective pieces of data, i.e., correspond to <D>, <2>, <4> . . . and <20>, are supplied to one source line in this order. Then, signal potentials, which have a negative polarity and correspond to the respective pieces of data, i.e., correspond to <D>, <1>, <3>, . . . and <19>, are supplied to the one source line in this order. Then, signal potentials which have the positive polarity and correspond to the respective pieces of data: <D>, <22>, <24> . . . are supplied to the one source line in this order.

It should be noted that any piece of data can be set as a piece of dummy data <D>. For example, a piece of dummy data <D> can be identical with a piece of video data whose signal potential is outputted immediately after the signal potential of the piece of dummy data <D>. Alternatively, the piece of dummy data <D> can be set to a piece of data whose signal potential is higher than that of a piece of video data whose signal potential is outputted immediately after the signal potential of the piece of dummy data <D>, from a viewpoint of an improvement in charging effect of a source line.

A waveform of a signal potential becomes blunt immediately after a polarity of the signal potential is reversed. In view of this, according to the arrangement, a dummy scanning period is secured immediately after a polarity reversal so that a predetermined signal potential (a signal potential corresponding to a piece of dummy data) is applied to a source line. This makes it possible to charge the source line during the dummy scanning period. This makes it possible to write a desired signal potential (an electric potential corresponding to a piece of video data) to a pixel during a horizontal scanning period which comes after a dummy scanning period. Further, it is possible to seemingly carry out dot inversion of respective opposite polarities of pixels by inverting respective opposite polarities of signal voltages to be applied to two adjacent source lines. This is effective against a flicker etc.

The liquid crystal display apparatus of the present invention is arranged such that: one horizontal scanning period HtotalY in actual outputting is shorter than one horizontal scanning period HtotalX set to a video data string to be inputted so that a vertical display period of one frame does not vary (i.e., so that a vertical blanking period VblankX set to video data strings to be inputted is equal to a vertical blanking period VblankY in actual outputting), even though, as described above, (i) a piece of dummy data is added to each of the groups which contains 10 pieces of video data and (ii) pieces of dummy data are outputted during respective dummy scanning periods.

Figure 7:
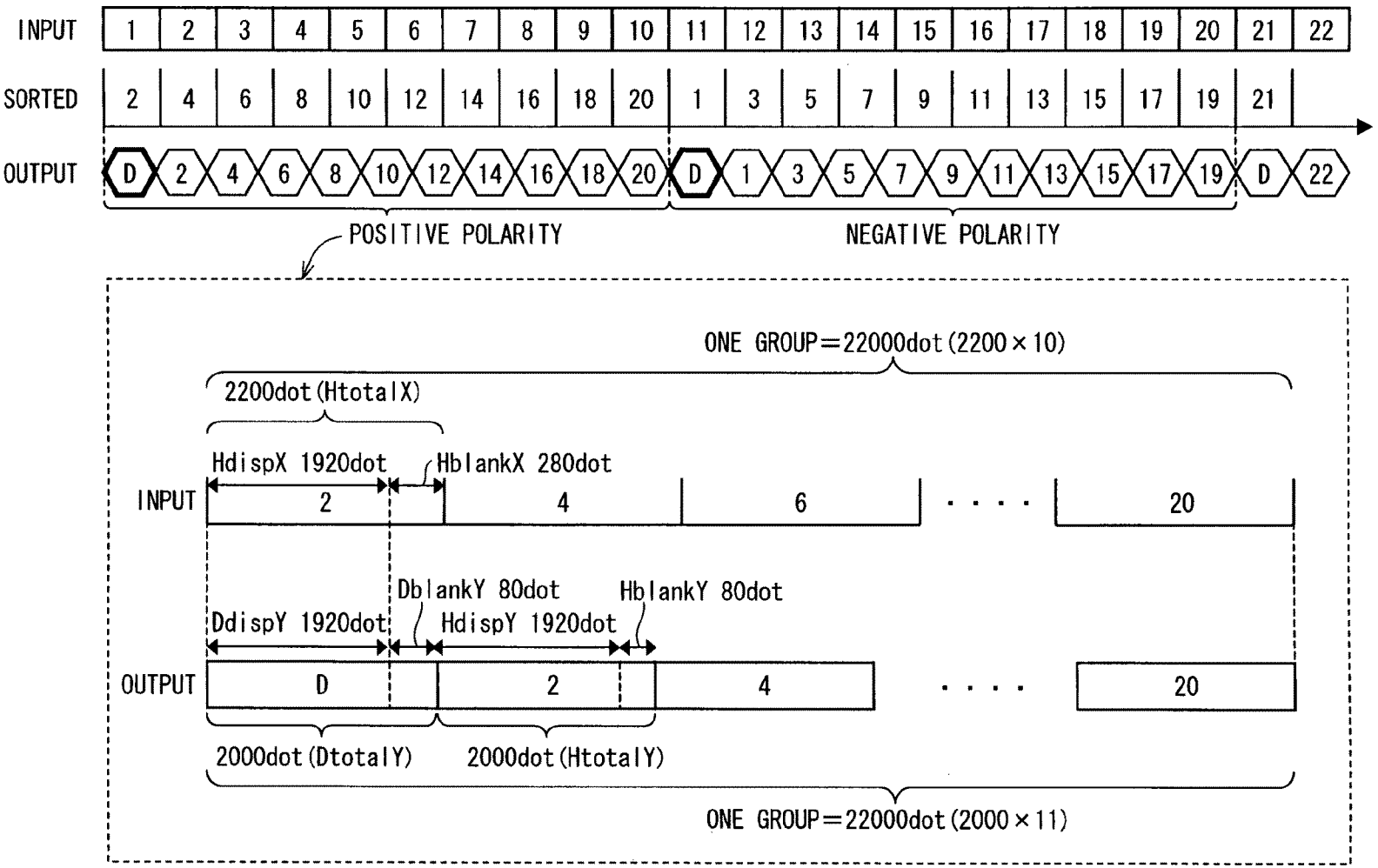
FIG. 7 is a schematic view illustrating yet another method for driving the liquid crystal display apparatus of the present invention.

More specifically, as illustrated in FIG. 7, the one horizontal scanning period HtotalY corresponding to 2000 dots is less than the one horizontal scanning period HtotalX corresponding to 2200 dots. Here, the one horizontal scanning period HtotalY corresponding to 2000 dots are made up of (i) a horizontal display period HdispY corresponding to 1920 dots and (ii) a horizontal blanking period HblankY corresponding to 80 dots. In contrast, the one horizontal scanning period HtotalX=horizontal display period HdispX (corresponding to 1920 dots)+horizontal blanking period HblankX (corresponding to 280 dots). Further, the dummy scanning period DtotalY corresponding to 2000 dots is less than the HtotalX, and the dummy scanning period DtotalY is made up of a dummy display period DdispY corresponding to 1920 dots and a dummy blanking period DblankY corresponding to 80 dots.

Figure 8:
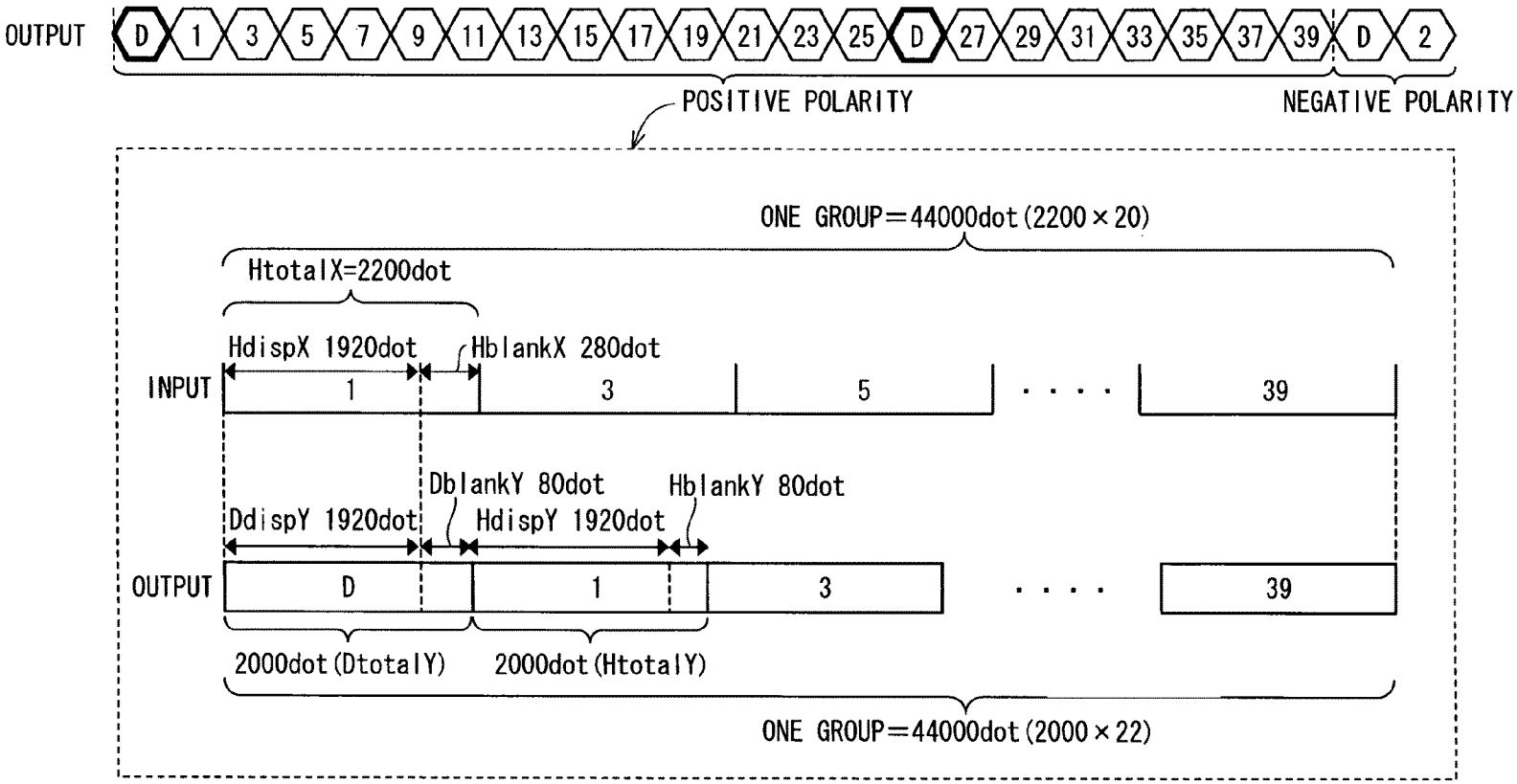
FIG. 8 is a schematic view illustrating still yet another method for driving the liquid crystal display apparatus of the present invention.

FIG. 8 illustrates (i) video data strings to be outputted, and (ii) relations among respective output periods of pieces of data, for a case where (i) pieces of video data are divided into a plurality of groups to each of which 20 pieces of video data (i.e., pieces of video data corresponding to one source line) belong, (ii) two pieces of dummy data are added at (i) a head and (ii) a position between the head and an end of each of the plurality of groups, respectively, (iii) signal potentials corresponding to respective pieces of data (the pieces of video data and the one piece of dummy data) are outputted, in sync with interlaced scanning of scanning signal lines, to respective source lines in the order in which the pieces of data are arranged, (iv) a signal potential corresponding to each of the plurality of pieces of video data is outputted during one horizontal period, and a signal potential corresponding to each of the at least one piece of dummy data is outputted during a dummy scanning period, and (v) polarities of the signal potentials are reversed group by group (reversal cycle=2 dummy scanning periods+20 horizontal scanning periods). Dummy scanning periods other than those provided immediately after polarity reversals are provided with the aim of timing adjustment of various kinds of signal processing.

Also in this case, as illustrated in FIG. 8, it is possible to provide dummy scanning periods, without changing a vertical display period corresponding to one frame, by arranging such that: one horizontal scanning period HtotalY corresponds to 2000 dots in actual outputting, which are less than HtotalX; and a dummy scanning period DtotalY corresponds to 2000 dots, which are less than HtotalX.

Figure 17:
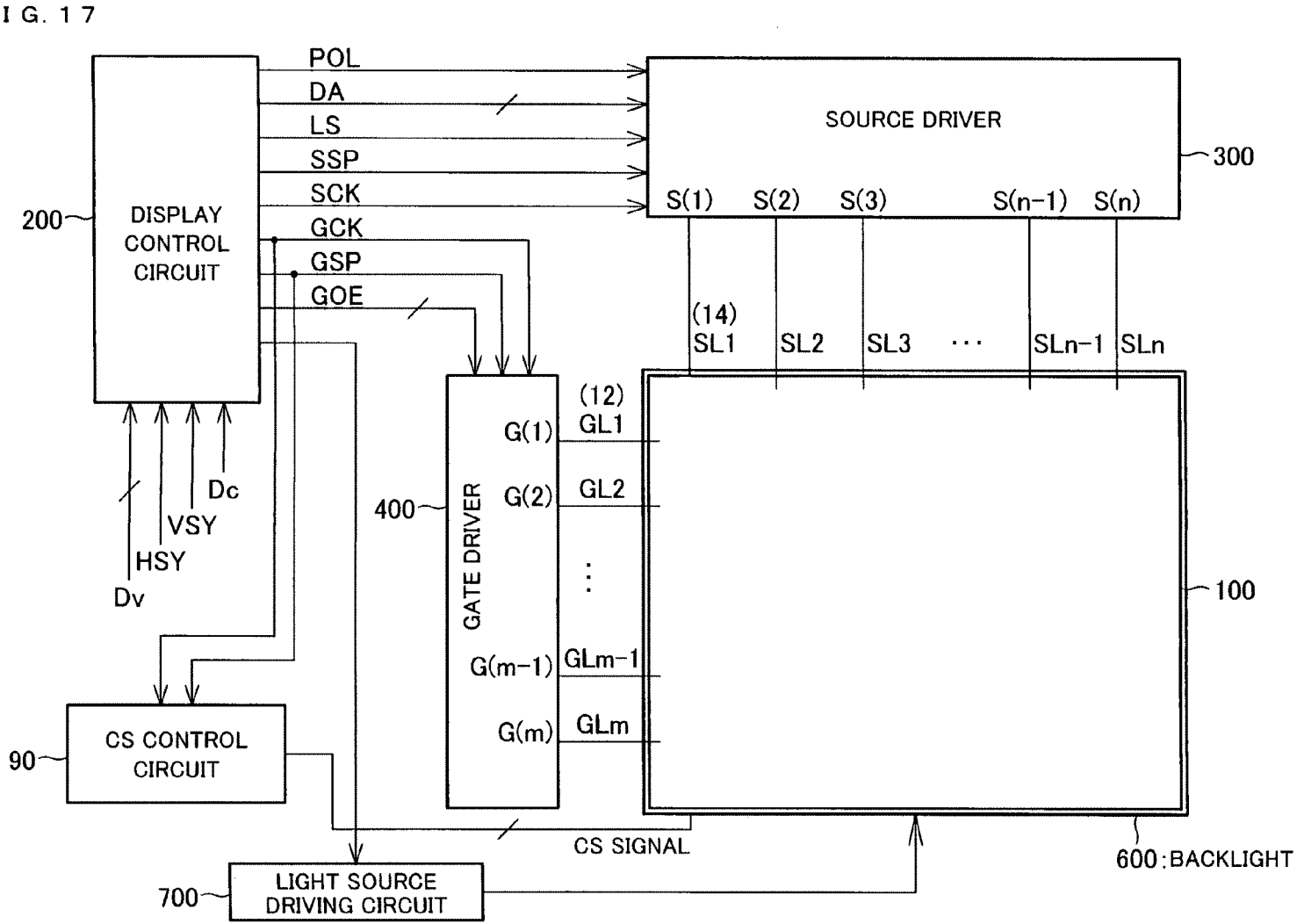
FIG. 17 is a plan view illustrating another arrangement of the liquid crystal display apparatus of the present invention.

A liquid crystal display apparatus can be alternatively arranged as is illustrated in FIG. 17. That is, according to such a liquid crystal display apparatus, (i) a CS control circuit 90 is added to the arrangement illustrated in FIG. 16 and (ii) the liquid crystal panel 100 illustrated in FIG. 17 is arranged so as to adopt a pixel division (multi-pixel driving) method. The CS control circuit 90 is a circuit for controlling features such as a phase and a width of a waveform of a CS signal to be applied to an auxiliary capacitor line (retention capacitor line: CS line). The CS control circuit 90 receives, from the display control circuit 200, a gate start pulse signal GSP, a gate clock signal GCK, and a data clock signal SKC.

According to the liquid crystal panel 100 employing a pixel division method, (i) a first pixel electrode and a second pixel electrode are provided for a pixel Px (not illustrated), (ii) a retention capacitance is defined by (a) a capacitor electrode connected to the first pixel electrode and (b) a retention capacitor line Csi, and (iii) a retention capacitance is defined by (A) a capacitor electrode connected to the second pixel electrode and (B) a retention capacitor line Csj. Two pixels Py and Pz are provided so as to be adjacent to the pixel Px in the column direction (Pixels Py and Pz). The pixel Px and the pixel Py share the retention capacitor line Csi whereas the pixel Px and the pixel Pz share the retention capacitor line Csj. Identical signal potentials are written into the two pixel electrodes of the pixel Px while a gate ON pulse is being supplied to a corresponding gate line. However, after the supplying of the gate ON pulse is stopped (i.e., after a gate OFF state), an overshoot potential and an undershoot potential (CS signals) are supplied to the retention capacitor lines Csi and Csj, respectively. This causes the first and second pixel electrodes to be controlled so as to have respective different electric potentials (effective electric potentials).

Figure 15:
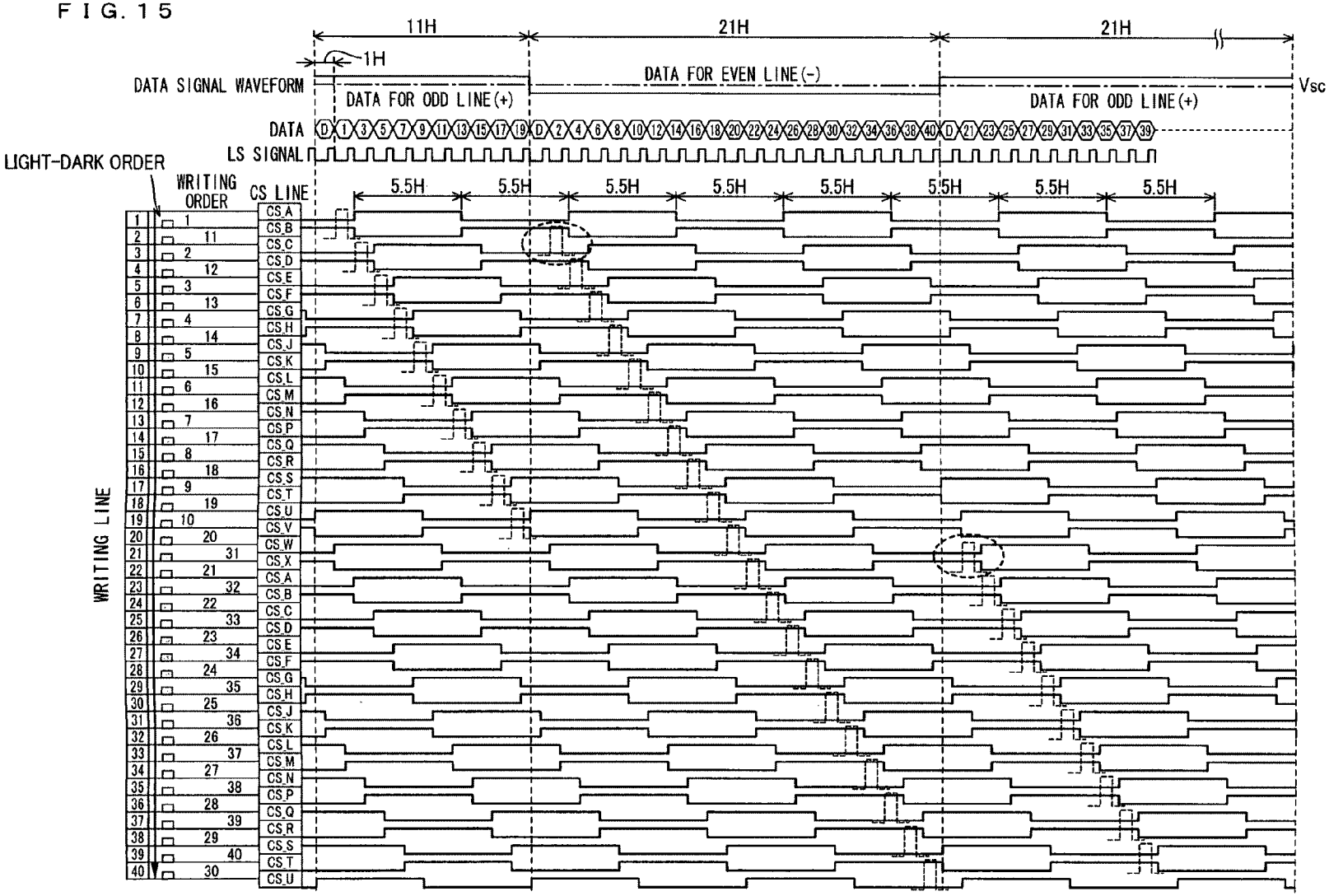
FIG. 15 is a timing chart illustrating still another method for driving the liquid crystal display apparatus of the present invention.

FIG. 15 shows (i) data strings (video data and dummy data) to be supplied, (ii) waveforms of signal potentials corresponding respectively to pieces of video data, (iii) and a timing chart of a latch strobe signal LS, gate ON pulses (data write pulses) Pw, and a CS signal, for a case where: in the liquid crystal display apparatus illustrated in FIG. 17, (i) first 10 pieces of video data (i.e., pieces of video data corresponding to one source line) are grouped into a first group, and one piece of dummy data is added at a head of the first group, (ii) subsequent pieces of video data are grouped by 20 pieces into a plurality of groups, and one piece of dummy data is added at a head of each of the plurality of groups, (iii) signal potentials corresponding to respective pieces of data (the pieces of video data and the at least one piece of dummy data) are outputted, in sync with interlaced scanning of scanning signal lines, to respective source lines in the order in which the pieces of data are arranged, and (iv) a signal potential corresponding to each of the plurality of pieces of video data is outputted during one horizontal period, and a signal potential corresponding to each of the at least one piece of dummy data is outputted during a dummy scanning period. The following pairs: CS_A and CS_B; CS_B and CS_C; CS_C and CS_D; . . . in FIG. 15 each correspond to a pair of retention capacitor lines Csi and Csj.

In this case, pieces of video data (not illustrated) to be inputted are arrayed as follows: 1, 2, 3, 4, 5, 6, 7, 8, 9, 10, 11, 12, 13, 14, 15, 16, . . . 43, 44, 45, 46, 47, 48, 49 where a piece of video data N (N=1, 2, 3 . . . ) corresponds to an N-th gate line. In the sorting circuit, (i) the pieces of video data are divided into groups for example as follows: 1, 3, 5, 7, 9, 11, 13, 15, 17, and 19; 2, 4, 6, 8, 10, 12, . . . 36, 38, and 40; 21, 23, 25, . . . 45, 47, and 49; 42, 44, 46, 48 . . . and (ii) a piece of dummy data is added at a head of each of the groups. With the arrangement, the pieces of data (the pieces of video data and the piece of dummy data) are outputted in the following order: <D>, <1>, <3>, <5>, <7>, <9>, <11>, <13>, <15>, <17>, and <19>, <D>, <2>, <4>, <6>, <8>, <10>, <12> . . . <36>, <38>, and <40>; <D>, <21>, <23>, <25>, <27>, . . . <45>, <47>, and <49>; <D>, <42>, <44>, . . . . Here, a piece of video data which corresponds to an N-th gate line is represented by <N>, and a piece of dummy data is represented by <D>. Signal potentials, which have a positive polarity and correspond to the respective pieces of data, i.e., correspond to <D>, <1>, <3>, <5> . . . <17>, and <19>, are supplied to one source line in this order. Then, signal potentials, which have a negative polarity and correspond to the respective pieces of data, i.e., correspond to <D>, <2>, <4>, <6>, <36>, <38>, and <40>, are supplied to the one source line in this order. Then, signal potentials which have the positive polarity and correspond to the respective pieces of data: <D>, <21>, <23>, <25>, <47>, and <49> are supplied to the one source line in this order. Then, signal potentials, which have a negative polarity and correspond to the respective pieces of data, i.e., correspond to <D>, <42>, <44>, . . . are supplied to the one source line in this order.

It should be noted that any piece of data can be set as a piece of dummy data <D>. For example, a piece of dummy data <D> can be identical with a piece of video data whose signal potential is outputted immediately after the signal potential of the piece of dummy data <D>. Alternatively, the piece of dummy data <D> can be set to a piece of data whose signal potential is higher than that of a piece of video data whose signal potential is outputted immediately after the signal potential of the piece of dummy data <D>, from a viewpoint of an improvement in charging effect of a source line.

In this case, it is possible to provide dummy scanning periods, without changing a vertical display period corresponding to one frame, by arranging such that: for the first group, one horizontal scanning period HtotalY corresponds to 2000 dots in actual outputting, which are less than HtotalX, and a dummy scanning period DtotalY corresponds to 2000 dots, which are less than HtotalX; and, for subsequent groups, one horizontal scanning period HtotalY corresponds to 2094 dots in actual outputting, which are less than HtotalX, and a dummy scanning period DtotalY corresponds to 2120 dots, which are less than HtotalX.

Figure 21:
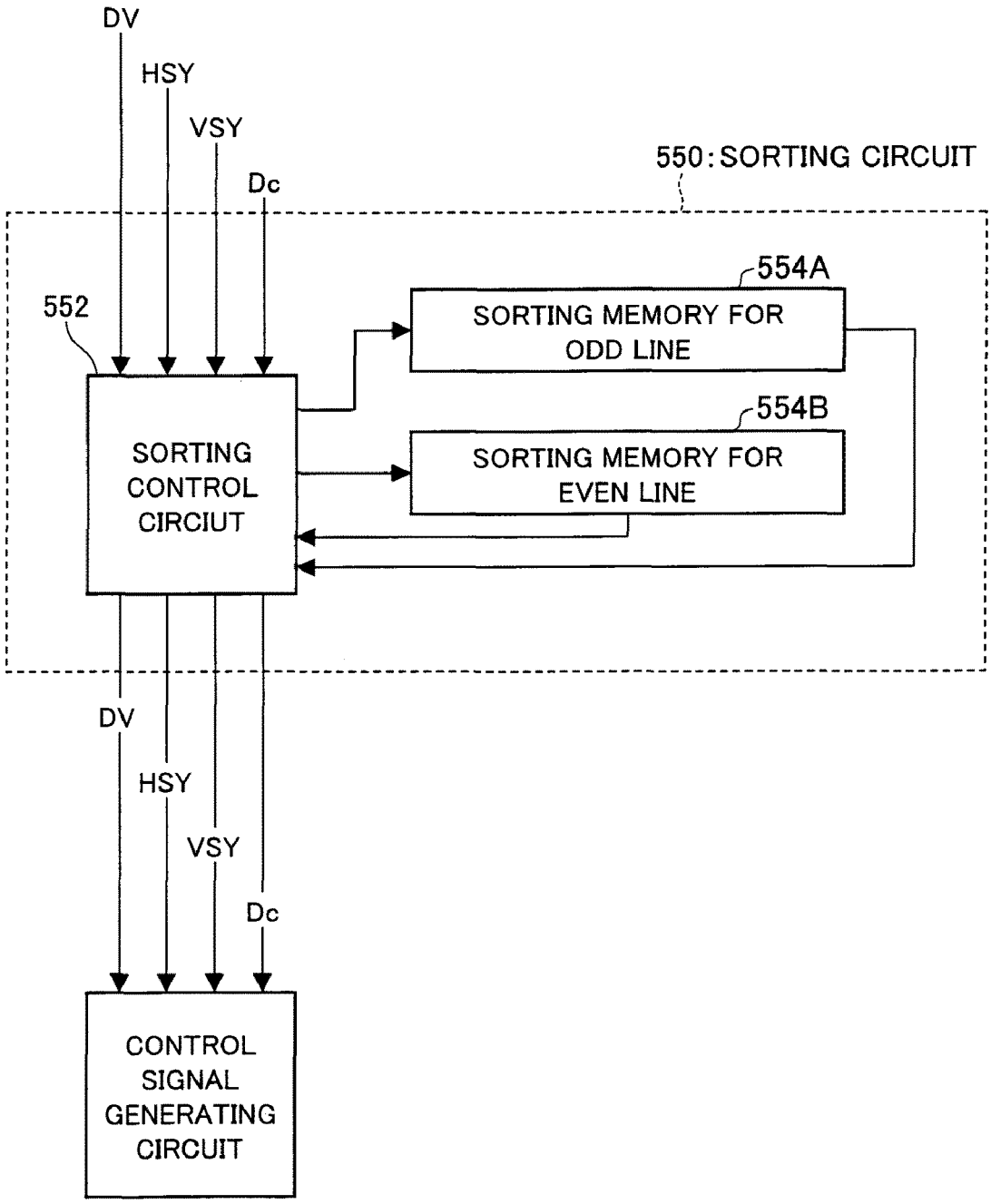
FIG. 21 is a schematic block diagram illustrating a sorting circuit.
Figure 22:
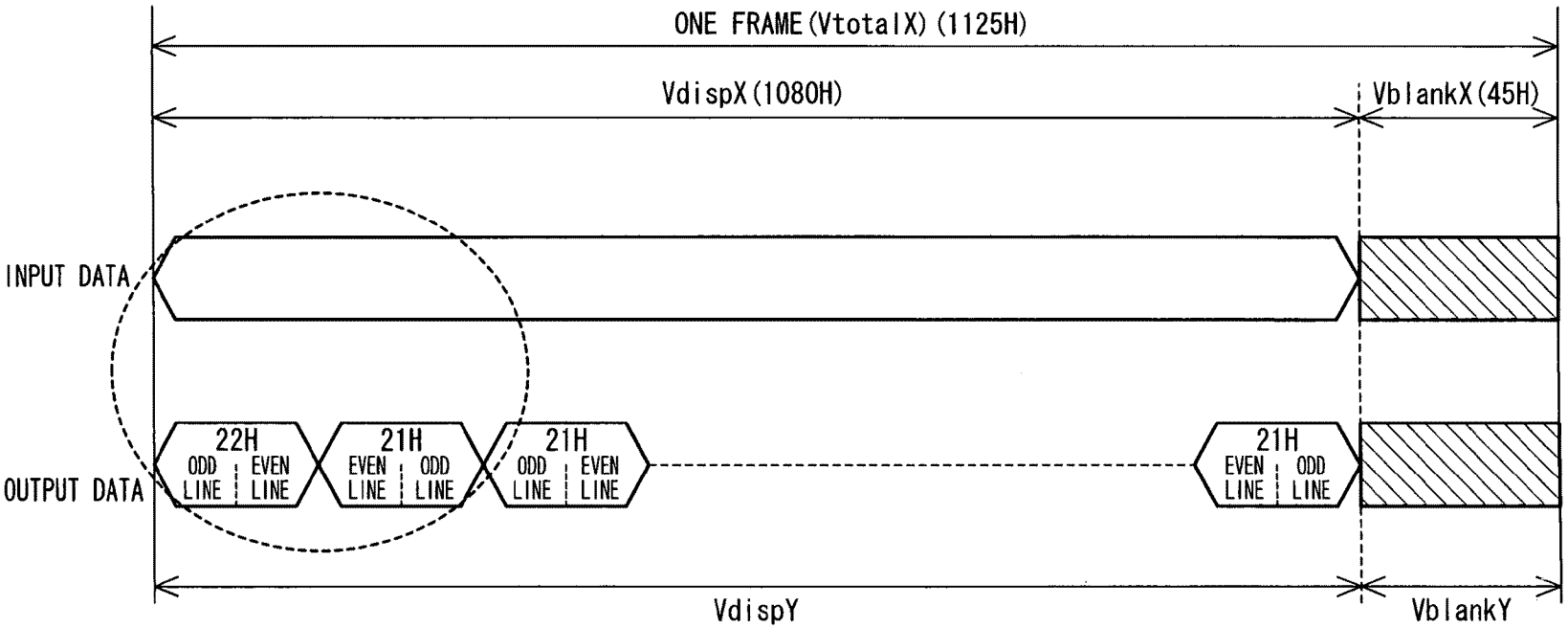
FIG. 22 is a schematic view illustrating a method for sorting data.
Figure 23:
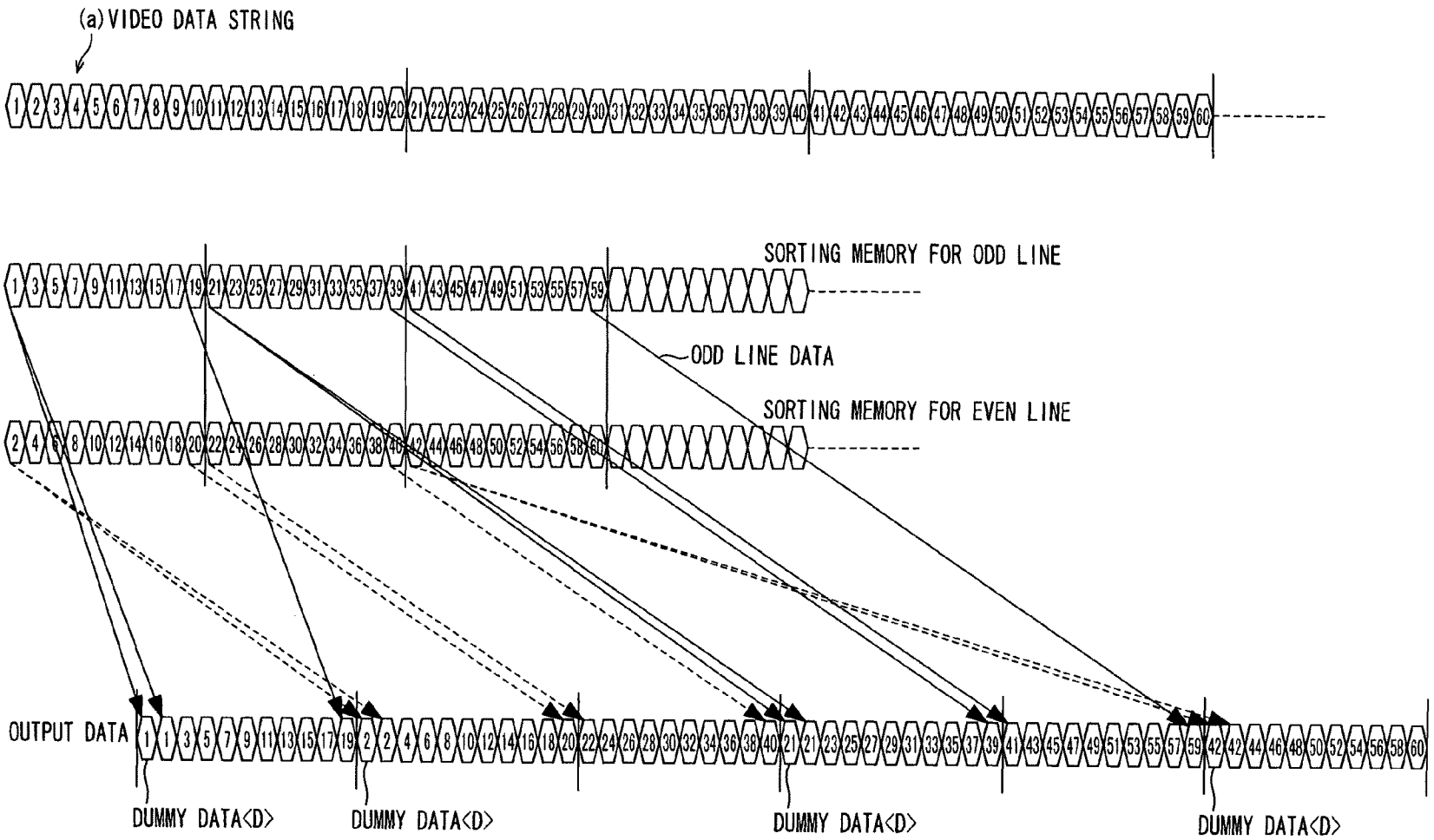
FIG. 23 is a schematic diagram illustrating an enlarged view of a part circled by a dashed line in FIG. 22.
Figure 24:
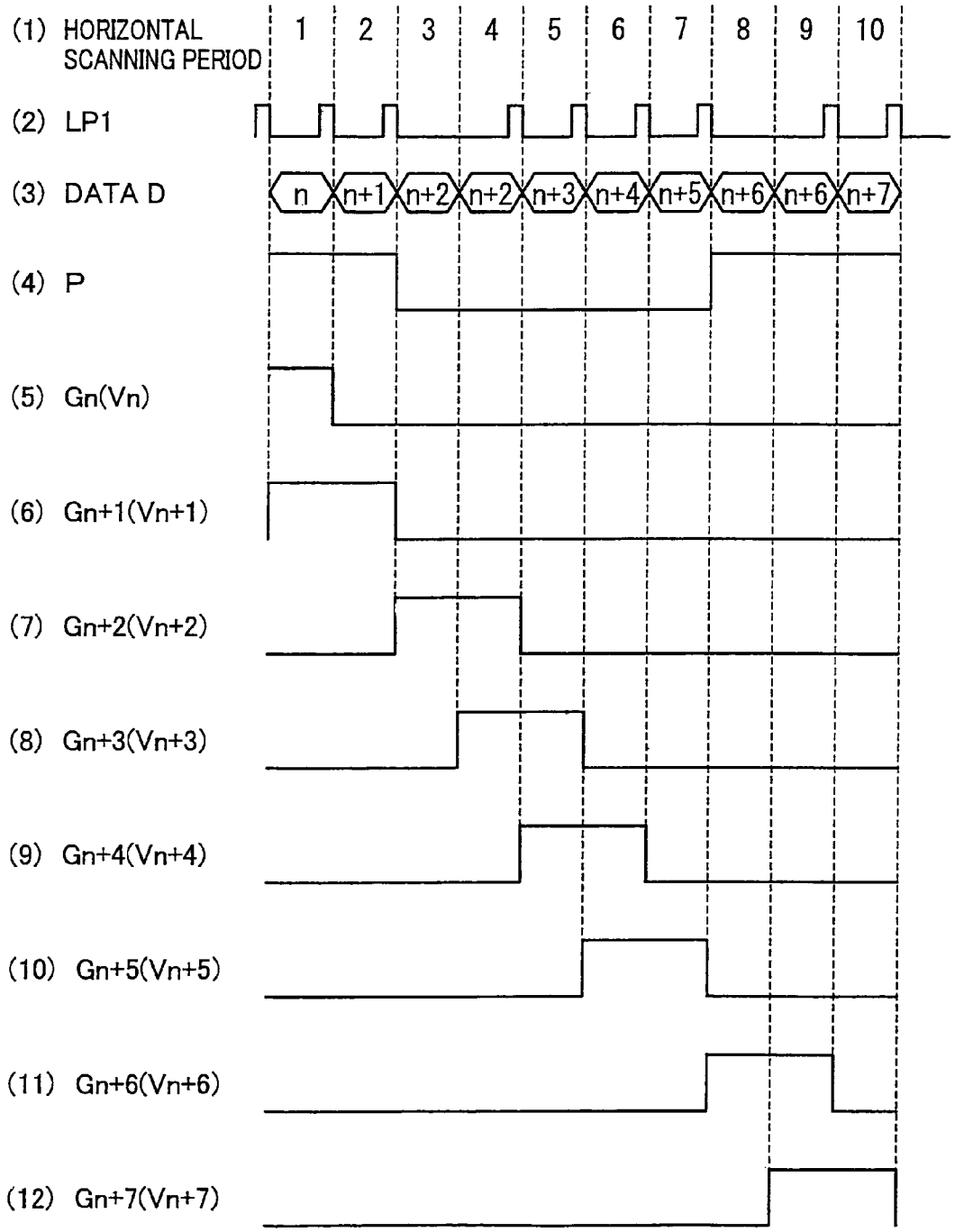
FIG. 24 Background Art
FIG. 24 is a timing chart illustrating a method for driving a conventional liquid crystal display apparatus.

The following is a description as to a method for sorting pieces of data, with reference to FIGS. 21 through 23. The following description deals with an example in which one vertical scanning period VtotalX is 1125H, a vertical display period VdispX is 1080H, and a vertical blanking period is 45H.

FIG. 21 is a schematic block diagram illustrating a sorting circuit. FIG. 22 is a view illustrating a method for sorting pieces of data. FIG. 23 is an enlarged view of a part circled by a dashed line in FIG. 22. As illustrated in FIG. 21, a sorting circuit 550 includes a sorting control circuit 552, a sorting memory 554A for odd-numbered lines, and a sorting memory 554B for even-numbered lines. The sorting circuit 550 is provided in, e.g., the display control circuit 200 illustrated in FIG. 17.

The sorting control circuit 552 receives pieces of video data to be displayed, a vertical sync signal and a horizontal sync signal which are in sync with the pieces of video data, and a control signal for controlling a display operation. The sorting control circuit 552 (i) separates, line by line, supplied pieces of video data into pieces of video data for odd-numbered lines and pieces of video data for even-numbered lines, (ii) continues to write, during a predetermined period, the pieces of video data for odd-numbered lines and the pieces of video data for even-numbered lines into the sorting memory 554A for odd-numbered lines and the sorting memory 554B for even-numbered lines, respectively, (iii) sequentially reads out the pieces of video data for odd-numbered lines from the sorting memory 554A, and (iv) then sequentially reads out the pieces of video data for even-numbered lines from the sorting memory 554B.

The sorting control circuit 552 counts the number of pieces of video data in accordance with the number of lines of each of the groups, reads out the pieces of video data from the sorting memories 554A and 554B, and adds a piece of dummy data <D> in a predetermined position in each of the groups (e.g., at a head of each of the groups). Both each one horizontal scanning period during which a piece of video data is outputted and each dummy scanning period during which a piece of dummy data is outputted are arranged to be shorter than one horizontal scanning period during which a piece of video data is inputted (i.e., shorter than each of intervals at which pieces of video data are inputted). The orders in which the pieces of video data are written into and read out are predetermined orders, by reference to a look-up table which is prepared in advance. This allows (i) a reduction in scale of each of the respective sorting memories 554A and 554B without using a frame memory for memorizing pieces of video data corresponding to one display screen, and (ii) suppression of a time-lag between inputting and outputting of each of the pieces of video data.

For example, as illustrated in FIG. 23, upon reception of a video data string (a), the sorting control circuit 552 separates and writes pieces of video data of the video data string (a) to the respective sorting memories for odd-numbered lines and for even-numbered lines. Here, the sorting control circuit 552 writes pieces of video data corresponding to at least 11 lines into the sorting memory 554A, and then initiates readout of pieces of video data from the sorting memory 554A for odd-numbered lines while continuing to write pieces of video data which are sequentially inputted to the sorting memories 554A and 554B. For simplicity, each piece of dummy data <D> is arranged to be identical with an immediately subsequent piece of video data.

Specifically, a first piece of video data (a piece of video data corresponding to a first gate line) is read out, as a piece of dummy data <D>, from the sorting memory 554A for odd-numbered lines. Then, 10 pieces of video data for 10 gate lines (i.e., for 1, 3, 5, . . . and $19^{th}$ line) are sequentially read out from the sorting memory 554A for odd-numbered lines. The first piece and the 10 pieces of video data thus read out belong to a first group. Then, a second piece of video data (a piece of video data for a second gate line) is read out as a piece of dummy data <D> from the sorting memory 554B for even-numbered lines. Then, 10 pieces of video data for 10 gate lines (i.e., for 2, 4, 6, . . . and $20^{th}$ line) are sequentially read out from the sorting memory 554B for even-numbered lines. Further, 10 pieces of video data for 10 gate lines (i.e., for 22, 24, 26, . . . and $40^{th}$ line) are sequentially read out from the sorting memory 554B for even-numbered lines. The second piece, the 10 pieces, and other 10 pieces of video data thus read out are grouped into a second group. Then, a $21^{st}$ piece of video data (i.e., a piece of video data for a $21^{st}$ gate line) is read out, as a piece of the dummy data <D> from the sorting memory 554A for odd-numbered lines. Then, 10 pieces of video data for 10 gate lines (i.e., for 21, 23, 25, . . . and $39^{th}$ line) are sequentially read out from the sorting memory 554A for odd-numbered lines. The $21^{st}$ piece and the 10 pieces of video data thus read out are grouped into a third group. The sorting control circuit 552 repeatedly controls a sequence of such operations, so that readouts from the sorting memories 554A and 554B are carried out with respect to from the first gate line to a last gate line.

In the example, a headmost piece of dummy data <D> (i.e., a piece of data which is identical with a piece of video data corresponding to a first gate line which is the headmost gate line of each of the groups) is included in a vertical display period VdispY. However, the example is not limited to this. Alternatively, the headmost piece of dummy data <D> can be provided as a rearmost piece of data in a vertical blanking period VblankY of a previous frame.

The following describes, in a case where M pieces of video data belong to each of the groups in each of the embodiments, (i) how many dummy scanning periods (i.e., how many pieces of dummy data) should be prepared for one group and (ii) how to find a combination of one horizontal scanning period HtotalY, during which a piece of video data is actually outputted, and a dummy scanning period DtotalY. Note, as described above, that such a finding process can be alternatively carried out by the display control circuit 200 (liquid crystal panel driving apparatus). In this case, the finding process can be carried out by causing a computer to execute a predetermined program.

Figure 9:
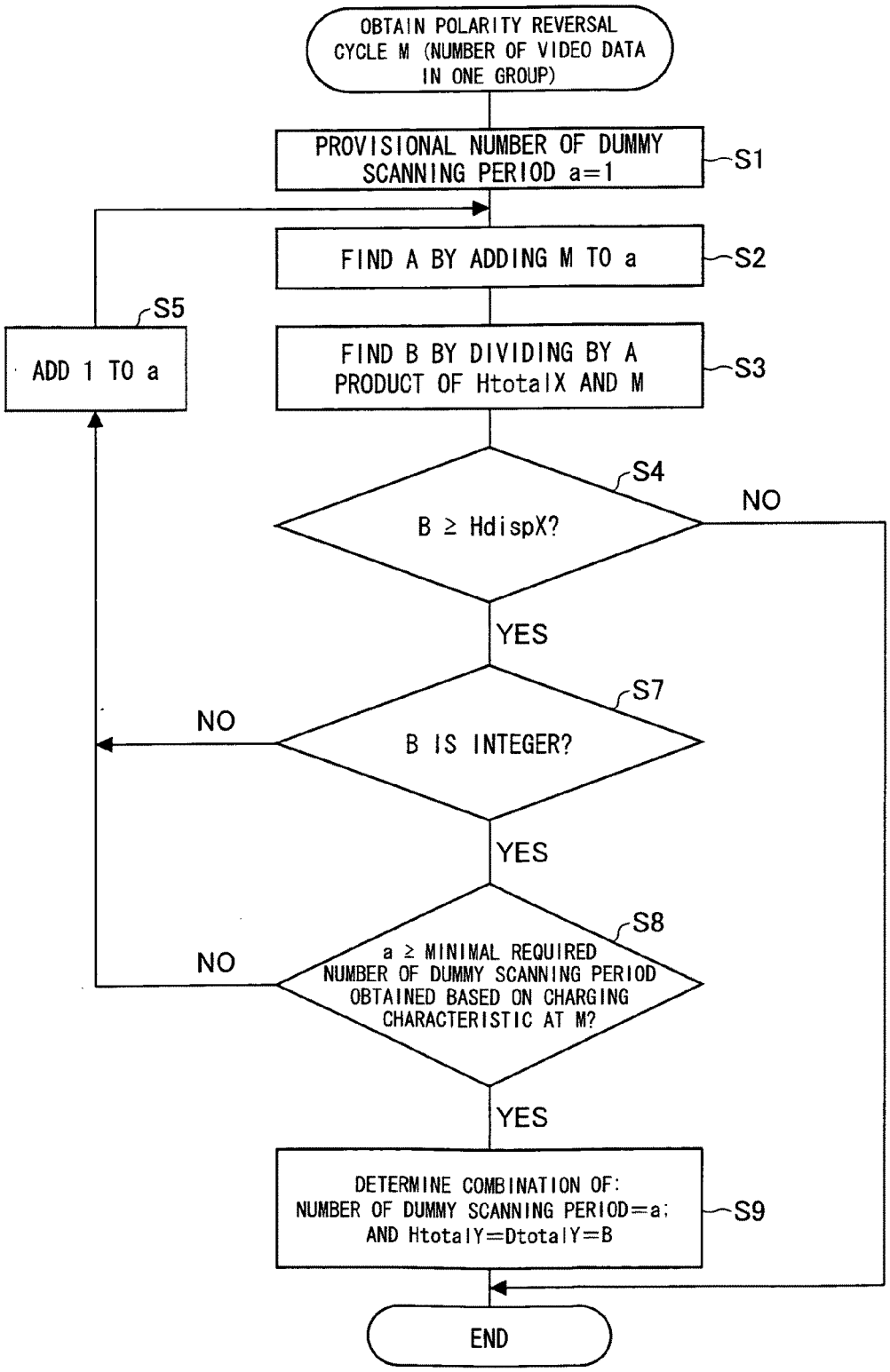
FIG. 9 is a flowchart showing an example of determination of a horizontal scanning period and a dummy scanning period of the liquid crystal display apparatus of the present invention.

FIG. 9 is a flowchart showing one example of how to find such a combination. As illustrated in FIG. 9, a polarity reversal cycle M (the number of pieces of video data in one group) is obtained first. Then, in S1, the provisional number "a" of dummy scanning periods (the number of pieces of dummy data in one group) is set to one (1). Then, in S2, A is found by adding M to "a." Then, in S3, B is found by dividing, by A, a product of HtotalX and M. Note while S1 is being carried out that, after the polarity reversal cycle M is obtained, the minimal required number C of dummy scanning periods can be determined on the basis of a charging characteristic obtained during the polarity reversal cycle M. In S4, it is determined whether or not B is not less than HdispX. If Yes, S7 is proceeded. In contrast, if No (i.e., if B is determined to be less than HdispX), the finding process ends. In S7, it is determined whether or not B is an integer. If Yes, S8 is processed. If No, S5 is processed. In S5, 1 is added to "a." Then, S2 is processed. In S8, it is determined whether or not "a" is not less than the minimal required number C of dummy scanning periods. If Yes, S9 is processed. If No on the contrary, S5 is processed. In S9, the number of dummy scanning periods is set to "a," and both HtotalY and DtotalY B are set to B. Then, the finding process ends.

According to the finding process, in the case of M=10, a combination of the number of dummy scanning periods=1 and HtotalY=DtotalY=2000 dots is found; in the case of M=30, a combination of the number of dummy scanning periods=3 and HtotalY=DtotalY=2000 dots is found; in the case of M=40, a combination of the number of dummy scanning periods=4 and HtotalY=DtotalY=2000 dots is found. Thus, the finding process makes it possible to promptly find a combination of HtotalY and DtotalY which satisfy HtotalY=DtotalY.

Figure 10:
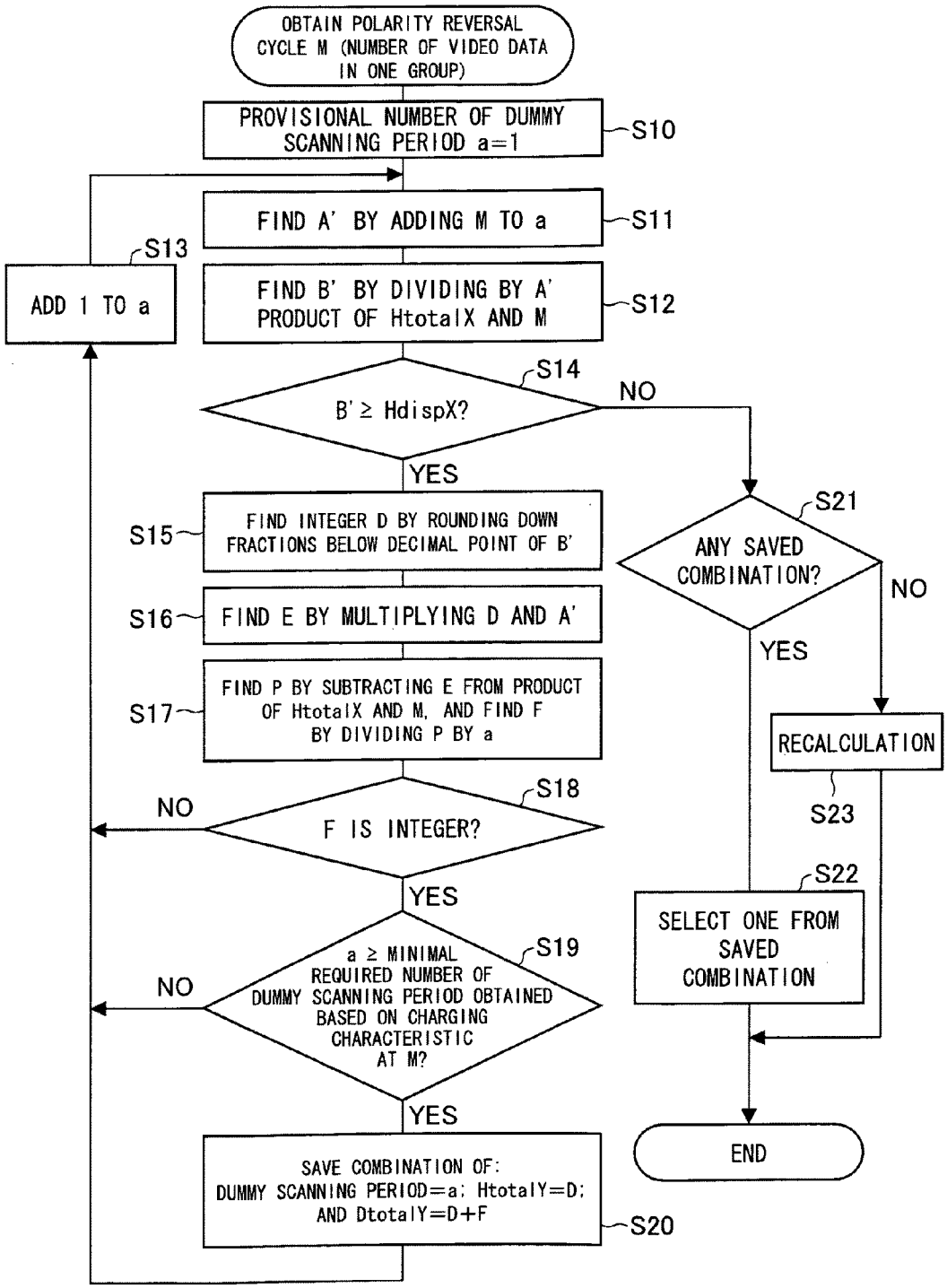
FIG. 10 is a flowchart showing another example of determination of a horizontal scanning period and a dummy scanning period of the liquid crystal display apparatus of the present invention.

Unfortunately, the finding process cannot find with a combination in case of M=20. In view of this, the following finding process can be adopted. The finding process is illustrated in FIG. 10. As illustrated in FIG. 10, a polarity reversal cycle M (the number of pieces of video data in one group) is obtained first. Then, in S10, a provisional number "a" of dummy scanning periods (the number of pieces of dummy data in one group) is set to one (1). Then, in S11, A' is found by adding M to "a." Then, in S12, B' is found by dividing, by A', a product of HtotalX and M. Note while S1 is being carried out that, after the polarity reversal cycle M is obtained, the minimal required number C of dummy scanning periods can be determined on the basis of a charging characteristic obtained during the polarity reversal cycle M. In S14, it is determined whether or not B' is not less than HdispX. If Yes, S15 is proceeded. In contrast, if No (i.e., if B' is determined to be less than HdispX), S21 is proceeded. In S15, an integer is found as D, by rounding down fractions below decimal point of B'. Then, in S16, E is found by multiplying D by A'. Then, in S17, P is found by subtracting E from a product of HtotalX and M, and then, F is found by dividing P by "a." Then, in S18, whether or not F is an integer or not is determined. If Yes, S19 is proceeded. If No, S13 is proceeded. In S13, 1 is added to "a." Then, S11 is proceeded again. In S19, it is determined whether or not "a" is not less than the minimal required number C of dummy scanning periods. If Yes, S20 is proceeded. If No, S13 is proceeded again. In S20, a combination of: the number of dummy scanning periods="a"; HtotalY=D; and DtotalY=D+F is saved. Then, S13 is proceeded again. In S21, it is determined whether or not there is any saved combination. If Yes, S22 is proceeded. If No, S23 is proceeded. In S23, recalculation (to be described later) is carried out. In S22, one is selected from (a) saved combination(s). Then, the finding process ends.

In the recalculation in S23: $\alpha$ and $\beta$ which satisfy the equation: HtotalX (2200)×M=M×$\alpha$+C×$\beta$ are found by use of C (the minimal required number C of dummy scanning periods); the number of dummy scanning periods is set to C; HtotalY is set to +; and DtotalY is set to $\beta$.

FIG. 11 shows calculated results found by use of the flowchart of FIG. 10. As shown in FIG. 11, in the case of M=30, the following are found: a combination of the number of dummy scanning periods=1, HtotalY=2129, and DtotalY=2130; a combination of the number of dummy scanning periods=2, HtotalY=2062, and DtotalY=2070; and a combination of the number of dummy scanning periods=3, HtotalY=2000, and DtotalY=2000. In the case of M=40, the following are found: a combination of the number of dummy scanning periods=1, HtotalY=2146, and DtotalY=2160; a combination of the number of dummy scanning periods=2, HtotalY=2095, and DtotalY=2100; a combination of the number of dummy scanning periods=4, HtotalY=2000, and DtotalY=2000; and a combination of the number of dummy scanning periods=5, HtotalY=1955, and DtotalY=1960. One combination is selected among the combinations.

According to the finding process illustrated in FIG. 10, a calculation is not carried out in the case of, e.g., M=40 and the number of dummy scanning periods "a"=3. Therefore, in such a case (i.e., in a case where the number of dummy scanning periods is predetermined), the recalculation described above can be carried out. FIG. 12 shows results of recalculation which are found in the case of M=40 and the number of dummy scanning periods=3. As shown in FIG. 12, in this case, seven combinations are obtained, and, among them, one combination (e.g., a combination of: M=40; the number of dummy scanning periods=3; HtotalY=2044; and DtotalY=2080) is selected.

Figure 18:
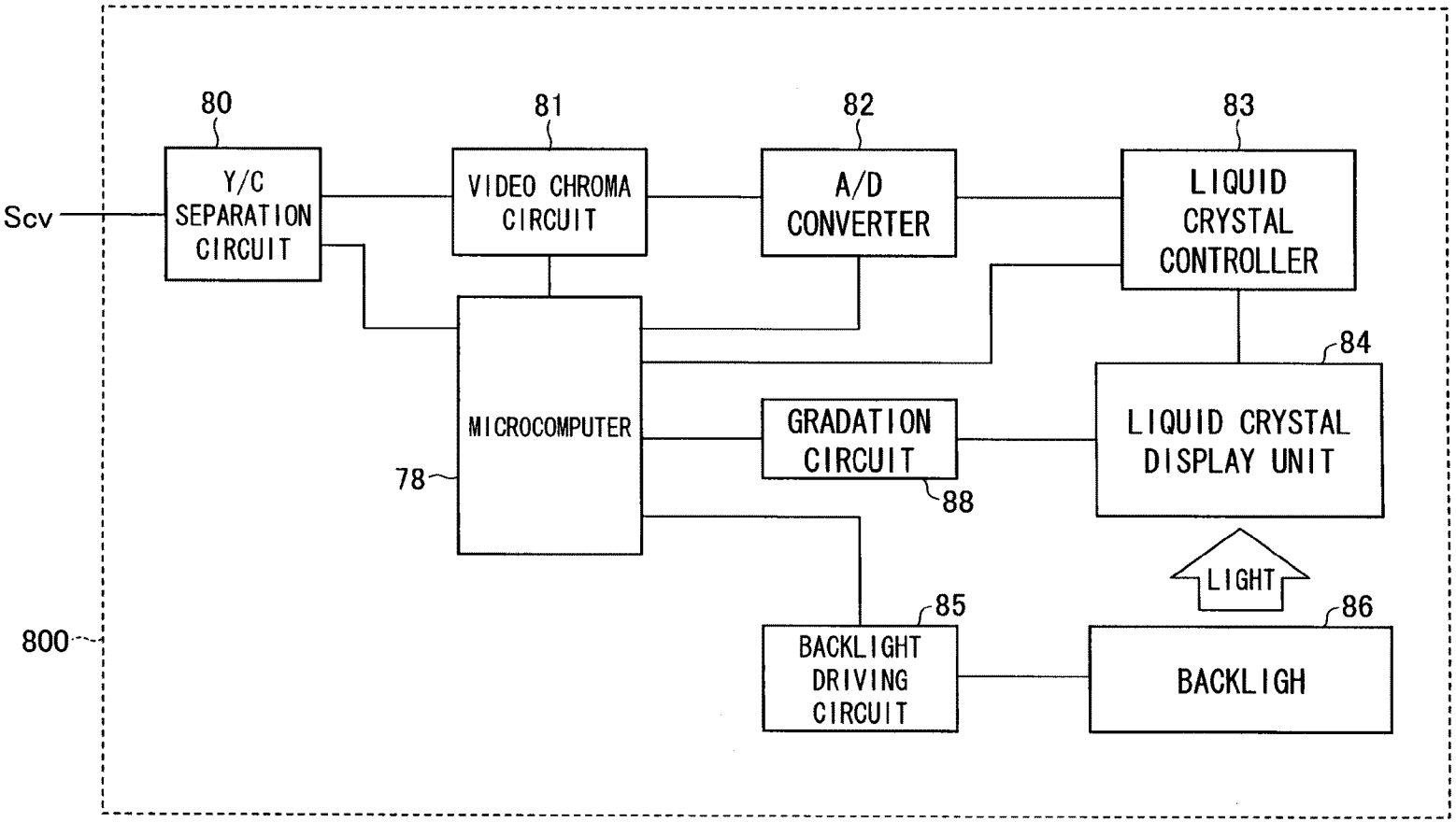
FIG. 18 is a block diagram illustrating an arrangement of a display apparatus for a television receiver.

The following describes an arrangement example of application of the liquid crystal display apparatus to a television receiver. FIG. 18 is a block diagram illustrating an arrangement of a liquid crystal display apparatus 800 for a television receiver. The liquid crystal display apparatus 800 includes a liquid crystal display unit 84, a Y/C separation circuit 80, a video chroma circuit 81, an A/D converter 82, a liquid crystal controller 83, a backlight driving circuit 85, a backlight 86, a microcomputer 78, and a gradation circuit 88. The liquid crystal display unit 84 includes: a liquid crystal panel, and a source driver and a gate driver for driving the liquid crystal panel. Each of the liquid crystal display apparatuses illustrated respectively in FIGS. 16 and 17 includes the following: a liquid crystal display unit 84, a backlight driving circuit 85, a backlight 86, and at least one of a microcomputer 78 and a liquid crystal controller 83.

In the liquid crystal display apparatus 800 arranged as above, a composite color video signal Scv is externally supplied, as a television signal, to the Y/C separation circuit 80, so as to be separated into a luminance signal and a color signal. The luminance signal and the color signal are converted by the video chroma circuit 81 into an analog RGB signal corresponding to three primary light colors. The analog RGB signal is converted into a digital RGB signal by the A/D converter 82. The digital RGB signal is supplied to the liquid crystal controller 83. In the Y/C separation circuit 80, a horizontal sync signal and a vertical sync signal are extracted from the composite color video signal Scv thus externally supplied. The horizontal sync signal and the vertical sync signal are also supplied to the liquid crystal controller 83 via the microcomputer 78.

The digital RGB signal and a timing signal generated in sync with the horizontal sync signal and the vertical sync signal are supplied from the liquid crystal controller 83 to the liquid crystal display unit 84 at a predetermined timing. In the gradation circuit 88, respective gradation voltages of three primary colors R, G, and B of color display are generated, so as to be also supplied to the liquid crystal display unit 84. In the liquid crystal display unit 84, internal members such as the source driver and the gate driver generate driving signals (i.e., data signals such as a signal potential and a scanning signal) in accordance with the digital RGB signal, the timing signal, and the gradation voltages. In accordance with the driving signals, the liquid crystal panel inside the liquid crystal display unit 84 displays a color image. In order that the liquid crystal display unit 84 displays an image, it is necessary to irradiate with light the liquid crystal panel inside the liquid crystal display unit 84 from behind. In the liquid crystal display apparatus 800, the backlight driving circuit 85 drives the backlight 86 under control of the microcomputer 78 so that a back surface of the liquid crystal panel is irradiated with light.

Overall control of the liquid crystal display apparatus 800, including the processes above, is carried out by the microcomputer 78. The video signal to be externally supplied (composite color video signal) is not limited to a video signal of television broadcast but can be a video signal such as one taken by use of a camera or one supplied via the Internet. Therefore, the liquid crystal display apparatus 800 is capable of displaying images in accordance with a wide variety of video signals.

Figure 19:
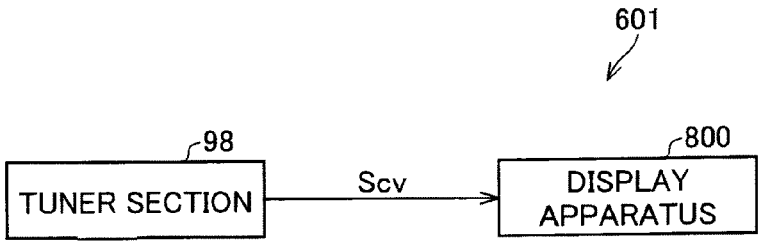
FIG. 19 is a block diagram illustrating a connection relation between a tuner section and the display apparatus.

In a case where the liquid crystal display apparatus 800 displays an image in accordance with a video signal of television broadcast, as illustrated in FIG. 19, a tuner section 98 is connected to the liquid crystal display apparatus 800, thereby constituting a television receiver 601. The tuner section 98 (i) extracts a signal of a channel which should be received, from an electric wave (high-frequency signal) received via an antenna (not illustrated), (ii) converts the signal thus extracted into an intermediate frequency signal, and (iii) detects the intermediate frequency signal. Thus, the tuner section 98 extracts a composite color video signal Scv as a television signal. As described, the composite color video signal Scv is supplied to the liquid crystal display apparatus 800 so that the liquid crystal display apparatus 800 displays an image in accordance with the composite color video signal Scv.

Figure 20:
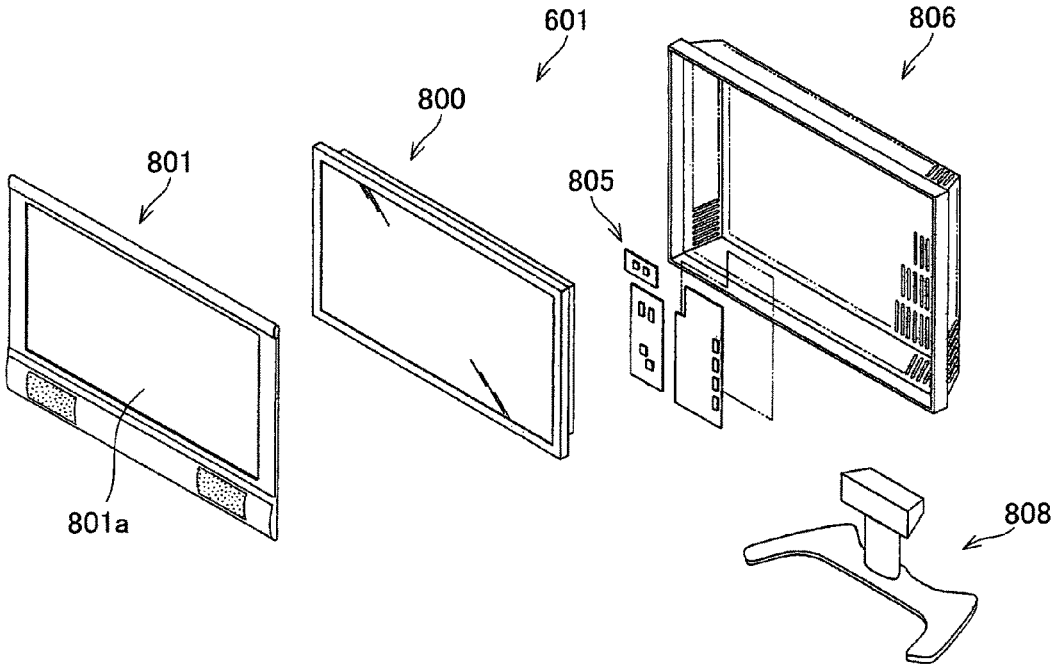
FIG. 20 is an exploded perspective view illustrating an, example of a mechanical arrangement of the display apparatus used as a television receiver.

FIG. 20 is an exploded perspective view illustrating an arrangement example of the television receiver. As illustrated in FIG. 20, the television receiver 601 includes, as its components, a first package 801 and a second package 806, in addition to the liquid crystal display apparatus 800. The television receiver 601 is arranged such that the first package 801 and the second package 806 sandwich the liquid crystal display apparatus 800 therebetween so as to encasing the liquid crystal display apparatus 800. The first package 801 has an opening 801*a* through which an image displayed by the liquid crystal display apparatus 800 is allowed to pass. The second package 806 is a member for covering a back surface of the liquid crystal display apparatus 800. The second package 806 includes an operation circuit 805 for a user to operate the liquid crystal display apparatus 800. A support 808 is attached to a bottom surface of the second package 806.

The invention being thus described is not limited to the aforementioned embodiment, but encompasses variations of the embodiment which are made on the basis of common general technical knowledge, and combinations of the variations.

INDUSTRIAL APPLICABILITY

The liquid crystal panel driving apparatus is suitable for, e.g., a liquid crystal television.

The invention claimed is:

1. A liquid crystal panel driving apparatus which sequentially receives, at intervals, pieces of video data each corresponding to one data signal line, wherein:

the pieces of video data are divided into groups to each of which a predetermined number of pieces of video data belong and in each of which a piece of dummy data is added in a predetermined position;

a signal potential corresponding to the piece of dummy data is outputted during a dummy scanning period;

a signal potential corresponding to each of the predetermined number of pieces of video data is outputted during one horizontal scanning period;

each of the intervals consists of a first horizontal display period and a first horizontal blanking period;

the one horizontal scanning period consists of a second horizontal display period and a second horizontal blanking period; and (i) a number of dots of the second horizontal display period is set to be identical to a number of dots of the first horizontal display period and (ii) a number of dots of the second horizontal blanking period is set to be less than a number of dots of the first horizontal blanking period so that the one horizontal scanning period is shorter than each of the intervals.

2. The liquid crystal panel driving apparatus as set forth in claim 1, wherein, in each of the groups, a product of (i) the number of the predetermined number of pieces of video data and (ii) any one of the intervals at which said apparatus sequentially receives the pieces of video data is equal to a sum of (I) a total of dummy scanning periods during each of which a corresponding piece of dummy data is outputted and (II) a total of horizontal scanning periods during which the respective predetermined number of pieces of video data are outputted.

3. The liquid crystal panel driving apparatus as set forth in claim 1, wherein the piece of dummy data is added at a head of each of the groups.

4. The liquid crystal panel driving apparatus as set forth in claim 1, wherein (i) each of signal potentials of respective predetermined number of pieces of video data and (ii) a signal potential of a piece of dummy data have a first polarity in one of adjacent ones of the groups, whereas (a) each of signal potentials of respective predetermined number of pieces of video data and (b) a signal potential of a piece of dummy data have a second polarity in the other of the adjacent ones of the groups.

5. The liquid crystal panel driving apparatus as set forth in claim 1, wherein:

the signal potentials corresponding to the respective predetermined number of pieces of video data are outputted to a corresponding data signal line in sync with scans of the respective scanning signal lines corresponding to the respective pieces of video data;

the signal potential corresponding to the piece of dummy data is outputted to the data signal line (i) in sync with a scan of a scanning signal line corresponding to a piece of video data whose signal potential is outputted immediately after the signal potential of the dummy data or (ii) between (a) a scan of a scanning signal line corresponding to a piece of video data whose signal potential is outputted immediately before the signal potential of the dummy data and (b) a scan of a scanning signal line corresponding to a piece of video data whose signal potential is outputted immediately after the signal potential of the dummy data; and the respective scanning signal lines are subjected to progressive scanning in accordance with how the predetermined number of pieces of video data are arranged in each of the groups.

6. The liquid crystal panel driving apparatus as set forth in claim 1, wherein:

the signal potentials corresponding to the respective predetermined number of pieces of video data are outputted to a corresponding data signal line in sync with scans of the respective scanning signal lines corresponding to the respective pieces of video data;

the signal potential corresponding to the piece of dummy data is outputted to the data signal line (i) in sync with a scan of a scanning signal line corresponding to a piece of video data whose signal potential is outputted immediately after the signal potential of the dummy data or (ii) between (a) a scan of a scanning signal line corresponding to a piece of video data whose signal potential is outputted immediately before the signal potential of the dummy data and (b) a scan of a scanning signal line corresponding to a piece of video data whose signal potential is outputted immediately after the signal potential of the dummy data; and the respective scanning signal lines are subjected to interlaced scanning in accordance with how the predetermined number pieces of video data are arranged in each of the groups.

7. The liquid crystal panel driving apparatus as set forth in claim 1, which generates, in accordance with the horizontal scanning period and the dummy scanning period, (i) a signal for controlling (a) timing at which the signal potentials corresponding to the respective predetermined number of pieces of video data are outputted and (b) timing at which the signal potential of the piece of dummy data is outputted, and (ii) a signal for controlling timing at which gate ON pulses are outputted to the respective scanning signal lines corresponding to the predetermined number of pieces of video data.

8. The liquid crystal panel driving apparatus as set forth in claim 1, said dummy scanning period and said at least one dummy scanning period are each set to be shorter than each of the intervals at which said apparatus sequentially receives the pieces of video data.

9. The liquid crystal panel driving apparatus as set forth in claim 1, said dummy scanning period and said at least one dummy scanning period are each set to be equal to one horizontal scanning period.

10. The liquid crystal panel driving apparatus as set forth in claim 1, said dummy scanning period and said at least one dummy scanning period are each set to be shorter than one horizontal scanning period.

11. The liquid crystal panel driving apparatus as set forth in claim 1, said dummy scanning period and said at least one dummy scanning period are each set to be longer than one horizontal scanning period.

12. The liquid crystal panel driving apparatus as set forth in claim 1, wherein the following steps (a) through (e) are carried out so as to find, for each of the groups, a combination of: (i) the number of dummy scanning periods; (ii) one horizontal scanning period; and (iii) a dummy scanning period, in a case where each of the groups has M horizontal scanning periods; the steps are:

(a) determining whether or not B is not less than a predetermined value, where "a" indicates a variable which is an integer of not less than 1, A is a sum of M and "a", and B is found by dividing, by A, a product of M and any one of the intervals at which said apparatus sequentially receives the pieces of video data, (b) determining whether or not F is an integer in a case where B is determined in the step (a) to be not less than the predetermined value, where D is an integer obtained by rounding down fractions below decimal point of B, E is a product of D and A, P is obtained by subtracting E from the product of M and any one of the intervals at which said apparatus sequentially receives the pieces of video data, and F is found by dividing P by "a,"

(c) determining whether or not "a" is not less than a minimal required number of dummy scanning periods in a case where F is determined in the step (b) to be an integer, where the minimal required number is obtained from a charging characteristic at M, (d) storing a combination of: a dummy scanning period of "a"; one horizontal scanning period of D; and a dummy scanning period of a sum of D and F, in a case where "a" is determined in the step (c) to be not less than the minimal required number of the dummy scanning periods, and (e) changing "a", and selecting one of combinations obtained by carrying out repeatedly the steps (a) through (d).

13. A liquid crystal display apparatus comprising a liquid crystal panel driving apparatus recited in claim 1.

14. A television receiver comprising:

a liquid crystal display apparatus recited in claim 13; and a tuner section for receiving television broadcast.

15. A liquid crystal panel driving apparatus which sequentially receives, at intervals, pieces of video data each corresponding to one data signal line, wherein:

the pieces of video data are divided into groups to each of which a predetermined number of pieces of video data belong and in each of which (i) a signal potential corresponding to a predetermined piece of video data is outputted during a period of sum of one horizontal scanning period and at least one dummy scanning period and (ii) each of signal potentials corresponding to respective pieces of video data other than the predetermined piece of video data is outputted during one horizontal scanning period;

each of the intervals consists of a first horizontal display period and a first horizontal blanking period;

the one horizontal scanning period consists of a second horizontal display period and a second horizontal blanking period; and (i) a number of dots of the second horizontal display period is set to be identical to a number of dots of the first horizontal display period and (ii) a number of dots of the second horizontal blanking period is set to be less than a number of dots of the first horizontal blanking period so that the one horizontal scanning period is shorter than each of the intervals.

16. The liquid crystal panel driving apparatus as set forth in claim 15, wherein, in each of the groups, a product of (i) the number of the predetermined number of pieces of video data and (ii) any one of the intervals at which said apparatus sequentially receives the pieces of video data is equal to a sum of (I) a total of horizontal scanning periods during each of which the signal potential corresponding to the predetermined piece of video data is outputted, (II) a total of at least one dummy scanning period during which the signal potential corresponding to the predetermined piece of video data is outputted, and (III) a total of horizontal scanning periods during which the each of signal potentials corresponding to the respective pieces of video data other than the predetermined piece of video data is outputted.

17. The liquid crystal panel driving apparatus as set forth in claim 15, wherein the predetermined piece of video data is a first piece of video data whose signal potential is outputted first in each of the groups.

18. The liquid crystal panel driving apparatus as set forth in claim 15, wherein signal potentials of respective predetermined number of pieces of video data have a first polarity in one of adjacent ones of the groups, whereas signal potentials of respective predetermined number of pieces of video data have a second polarity in the other of the adjacent ones of the groups.

19. The liquid crystal panel driving apparatus as set forth in claim 15: wherein signal potentials corresponding to the respective predetermined number of pieces of video data are outputted to a corresponding data signal line in sync with scans of the respective scanning signal lines corresponding to the respective pieces of video data; and the respective scanning signal lines are subjected to progressive scanning in accordance with how the predetermined number of pieces of video data are arranged in each of the groups.

20. The liquid crystal panel driving apparatus as set forth in claim 15: wherein signal potentials corresponding to the respective predetermined number of pieces of video data are outputted to a corresponding data signal line in sync with scans of the respective scanning signal lines corresponding to the respective pieces of video data; and the respective scanning signal lines are subjected to interlaced scanning in accordance with how the predetermined number of pieces of video data are arranged in each of the groups.

21. The liquid crystal panel driving apparatus as set forth in claim 15, wherein the predetermined piece of video data includes a first piece of video data and another piece of video data, in each of the groups.

22. The liquid crystal panel driving apparatus as set forth in claim 15, said dummy scanning period and said at least one dummy scanning period are each set to be shorter than each of the intervals at which said apparatus sequentially receives the pieces of video data.

23. The liquid crystal panel driving apparatus as set forth in claim 15, said dummy scanning period and said at least one dummy scanning period are each set to be equal to one horizontal scanning period.

24. The liquid crystal panel driving apparatus as set forth in claim 15, said dummy scanning period and said at least one dummy scanning period are each set to be shorter than one horizontal scanning period.

25. The liquid crystal panel driving apparatus as set forth in claim 15, said dummy scanning period and said at least one dummy scanning period are each set to be longer than one horizontal scanning period.

26. The liquid crystal panel driving apparatus as set forth in claim 8, wherein the following steps (a) through (e) are carried out so as to find, for each of the groups, a combination of: (i) the number of dummy scanning periods; (ii) one horizontal scanning period; and (iii) a dummy scanning period, in a case where each of the groups has M horizontal scanning periods; the steps are:

(a) determining whether or not B is not less than a predetermined value, where "a" indicates a variable which is an integer of not less than 1, A is a sum of M and "a", and B is found by dividing, by A, a product of M and any one of the intervals at which said apparatus sequentially receives the pieces of video data, (b) determining whether or not F is an integer in a case where B is determined in the step (a) to be not less than the predetermined value, where D is an integer obtained by rounding down fractions below decimal point of B, E is a product of D and A, P is obtained by subtracting E from the product of M and any one of the intervals at which said apparatus sequentially receives the pieces of video data, and F is found by dividing P by "a,"

(c) determining whether or not "a" is not less than a minimal required number of dummy scanning periods in a case where F is determined in the step (b) to be an integer, where the minimal required number is obtained from a charging characteristic at M, (d) storing a combination of: a dummy scanning period of "a"; one horizontal scanning period of D; and a dummy scanning period of a sum of D and F, in a case where "a" is determined in the step (c) to be not less than the minimal required number of the dummy scanning periods, and (e) changing "a", and selecting one of combinations obtained by carrying out repeatedly the steps (a) through (d).

27. A liquid crystal display apparatus comprising a liquid crystal panel driving apparatus recited in claim 15.

28. A television receiver comprising:

a liquid crystal display apparatus recited in claim 27; and a tuner section for receiving television broadcast.

29. A method for driving a liquid crystal display apparatus which sequentially receives, at intervals, pieces of video data each corresponding to one data signal line, and each of the intervals consisting of a first horizontal display period and a first horizontal blanking period;

said method comprising the steps of:

dividing the pieces of video data into groups to each of which a predetermined number of pieces of video data belong and in each of which (i) a signal potential corresponding to a predetermined piece of video data is outputted during a period of sum of one horizontal scanning period and at least one dummy scanning period and (ii) each of signal potentials corresponding to respective pieces of video data other than the predetermined piece of video data is outputted during one horizontal scanning period, the one horizontal scanning period consisting of a second horizontal display period and a second horizontal blanking period, and (i) setting a number of dots of the second horizontal display period to be identical to a number of dots of the first horizontal display period and (ii) setting a number of dots of the second horizontal blanking period to be less than a number of dots of the first horizontal blanking period so that the one horizontal scanning period is shorter than each of the intervals.

30. The method for driving a liquid crystal display apparatus as set forth in claim 29, wherein:

in each of the groups, a sum of (I) a total of horizontal scanning periods during each of which the signal potential corresponding to the predetermined piece of video data is outputted, (II) a total of at least one dummy scanning period during which the signal potential corresponding to the predetermined piece of video data is outputted, and (III) a total of horizontal scanning periods during which the each of signal potentials corresponding to the respective pieces of video data other than the predetermined piece of video data is outputted is equal to a product of (i) the number of the predetermined number of pieces of video data and (ii) any one of the intervals at which said apparatus sequentially receives the pieces of video data.

31. A liquid crystal panel driving apparatus which sequentially receives pieces of video data each corresponding to one data signal line, wherein:

the pieces of video data are divided into data strings in each of which (i) a predetermined number of pieces of video data, which are supplied in a predetermined period, are arranged in an order in which they are outputted and (ii) a piece of dummy data is added in a predetermined position;

each of the predetermined number of pieces of video data is outputted during one horizontal scanning period and the piece of dummy data is outputted during one dummy scanning period; and each of the intervals at which the predetermined number of pieces of video data are supplied consists of a first horizontal display period and a first horizontal blanking period;

the one horizontal scanning period consists of a second horizontal display period and a second horizontal blanking period; and (i) a number of dots of the second horizontal display period is set to be identical to a number of dots of the first horizontal display period and (ii) a number of dots of the second horizontal blanking period is set to be less than a number of dots of the first horizontal blanking period so that one horizontal scanning period is shorter than each of the intervals.

32. The liquid crystal panel driving apparatus as set forth in claim 31, wherein the predetermined period is equal to a sum of (i) a product of the number of the predetermined number of pieces of video data in each of the data strings and one horizontal scanning period and (ii) a product of the number of pieces of dummy data in a corresponding one of the data strings and a dummy scanning period.

33. The liquid crystal panel driving apparatus as set forth in claim 31, wherein the predetermined period is equal to a period found by subtracting a vertical blanking period from one vertical scanning period.

34. The liquid crystal panel driving apparatus as set forth in claim 31, wherein each of the data strings is made up of a plurality of groups arranged in chronological order;

each of the plurality of groups has a piece of dummy data as a first piece of data, and a plurality of pieces of video data, as subsequent pieces of data; and signal potentials of a piece of dummy data and a plurality of pieces of video data have a first polarity in one of adjacent ones of the groups, whereas signal potentials of a piece of dummy data and a plurality of pieces of video data have a second polarity in the other of the adjacent ones of the groups.

35. The liquid crystal panel driving apparatus as set forth in claim 34, wherein:

the signal potentials corresponding to the respective predetermined number of pieces of video data are outputted to a corresponding data signal line in sync with scans of the respective scanning signal lines corresponding to the respective pieces of video data; and the signal potential corresponding to the piece of dummy data is outputted to the data signal line between (a) a scan of a scanning signal line corresponding to a piece of video data whose signal potential is outputted immediately before the signal potential of the dummy data and (b) a scan of a scanning signal line corresponding to a piece of video data whose signal potential is outputted immediately after the signal potential of the dummy data.

36. The liquid crystal panel driving apparatus as set forth in claim 34, wherein a signal potential corresponding to the piece of dummy data is equal to a signal potential corresponding to a piece of video data whose signal potential is outputted immediately after the signal potential of the piece of dummy data.

37. The liquid crystal panel driving apparatus as set forth in claim 31, wherein the order in which the predetermined number of pieces of video data are arranged complies with progressive scanning or interlaced scanning which are carried out with respect to the scanning signal lines.

38. A method for driving a liquid crystal display apparatus which sequentially receives, at intervals, pieces of video data each corresponding to one data signal line, and each of the intervals consisting of a first horizontal display period and a first horizontal blanking period, said method comprising the steps of:

dividing the pieces of video data into groups to each of which a predetermined number of pieces of video data belong and in each of which a piece of dummy data is added in a predetermined position;

outputting a signal potential corresponding to the piece of dummy data during a dummy scanning period;

outputting a signal potential corresponding to each of the predetermined number of pieces of video data during one horizontal scanning period, the one horizontal scanning period consisting of a second horizontal display period and a second horizontal blanking period; and (i) setting a number of dots of the second horizontal display period to be identical to a number of dots of the first horizontal display period and (ii) setting a number of dots of the second horizontal blanking period to be less than a number of dots of the first horizontal blanking period so that the one horizontal scanning period is shorter than each of the intervals.

39. The method for driving a liquid crystal display apparatus as set forth in claim 38, wherein, in each of the groups, a sum of (i) a total of dummy scanning periods during each of which a corresponding piece of dummy data is outputted and (ii) a total of horizontal scanning periods during which the each of the predetermined number of pieces of video data is outputted is equal to a product of (I) the number of the predetermined number of pieces of video data and (II) any one of the intervals at which said apparatus sequentially receives the pieces of video data.

40. A method for driving a liquid crystal display apparatus which sequentially receives pieces of video data each corresponding to one data signal line, each of intervals at which the pieces of video data are supplied consisting of a first horizontal display period and a first horizontal blanking period, said method comprising the steps of:

dividing the pieces of video data into data strings in each of which (i) a predetermined number of pieces of video data, which are supplied in a predetermined period, are arranged in an order in which they are outputted and (ii) a piece of dummy data is added in a predetermined position;

outputting each of the predetermined number of pieces of video data during one horizontal scanning period;

outputting the piece of dummy data during one dummy scanning period; and (i) setting a number of dots of the second horizontal display period to be identical to a number of dots of the first horizontal display period and (ii) setting a number of dots of the second horizontal blanking period to be less than a number of dots of the first horizontal blanking period so that one horizontal scanning period is shorter than each of intervals.

41. The method for driving a liquid crystal display apparatus as set forth in claim 40, wherein:

the predetermined period is equal to a sum of (i) a product of the number of the predetermined number of pieces of video data in each of the data strings and one horizontal scanning period and (ii) a product of the number of pieces of dummy data in a corresponding one of the data strings and a dummy scanning period.

* * * * *